US006425157B1

(12) United States Patent
Ouchi et al.

(10) Patent No.: US 6,425,157 B1
(45) Date of Patent: Jul. 30, 2002

(54) ELEVATED BRIDGE INFRASTRUCTURE DESIGN METHOD

(75) Inventors: Hajime Ouchi, Iruma; Motoyuki Okano, Tokyo; Hajime Wakui, Kokubunji; Nobuyuki Mastsumoto, Kunitachi; Masamichi Sogabe, Kokubunji; Hiroyuki Arita, Morioka; Michiaki Oyado, Musashino, all of (JP)

(73) Assignees: Obayashi Corporation, Osaka; Railway Technical Research Institute, Tokyo, both of (JP)

( * ) Notice: Subject to any disclaimer, the term of this patent is extended or adjusted under 35 U.S.C. 154(b) by 0 days.

(21) Appl. No.: 09/584,143

(22) Filed: May 31, 2000

(30) Foreign Application Priority Data

Jun. 1, 1999 (JP) ..... 11-153740
Jul. 12, 1999 (JP) ..... 11-197162
Feb. 9, 2000 (JP) ..... 2000-031700

(51) Int. Cl.[7] ..... E01D 21/00
(52) U.S. Cl. ..... 14/77.1; 52/167.1; 703/1
(58) Field of Search ..... 14/13, 74.5, 77.1, 14/78; 52/167.1, 167.3; 703/1

(56) References Cited

U.S. PATENT DOCUMENTS 3,638,377 A * 2/1972 Caspe ..... 52/167.1
4,061,017 A * 12/1977 Sloane et al. ..... 73/579
4,417,427 A * 11/1983 Bschorr ..... 52/167.1
4,480,348 A * 11/1984 Finsterwalder ..... 14/18
4,964,246 A * 10/1990 Kobori et al. ..... 52/1
5,271,197 A * 12/1993 Uno et al. ..... 52/167.1
5,533,307 A * 7/1996 Tsai et al. ..... 52/167.3
5,630,298 A * 5/1997 Tsai et al. ..... 52/167.3
5,657,588 A * 8/1997 Axon ..... 52/167.1
5,870,863 A * 2/1999 Taylor ..... 52/167.3
5,979,126 A * 11/1999 Kurino et al. ..... 52/167.2
6,044,210 A * 3/2000 Nagtegaal ..... 395/500.1
6,237,303 B1 * 5/2001 Allen et al. ..... 52/729.1

FOREIGN PATENT DOCUMENTS

JP 10-298916 11/1998

* cited by examiner

*Primary Examiner*—H. Shackelford
*Assistant Examiner*—Gary S. Hartman
(74) *Attorney, Agent, or Firm*—Wenderoth, Lind & Ponack, L.L.P.

(57) ABSTRACT

In order to design an infrastructure of an elevated bridge, first a target ductility factor $\mu d$ and target natural period $T_d$ for the infrastructure are set in connection with an assumed earthquake motion. Subsequently, a yield seismic coefficient for the target ductility factor $\mu_d$ and target natural period $T_d$ is obtained from a yield seismic coefficient spectrum for the assumed earthquake motion as a design seismic coefficient $K_h$. On the other hand, a target yield rigidity $K_d$ corresponding to the target natural period $T_d$ is obtained. Subsequently, the design seismic coefficient $K_h$ is used to obtain a design horizontal load bearing capacity $H_d$ and a displacement corresponding to the design horizontal load bearing capacity $H_d$ is obtained as a design yield displacement $\delta_d$ from the target yield rigidity $K_d$. Subsequently, the design horizontal load bearing capacity $H_d$ is distributed into a horizontal force $H_f$ to be borne by the RC rigid frame and a horizontal force $H_b$ to be borne by the damper-brace. Next, member sections of the RC rigid frame and the damper-brace are set so that the RC rigid frame and the damper-brace resist the horizontal forces $H_f$, $H_b$ with ultimate load bearing capacities and displacements corresponding to the horizontal forces $H_f$, $H_b$ equal the product of the design yield displacement $\delta_d$ and target ductility factor $\mu_d$, that is, $\delta_d\mu_d$.

6 Claims, 24 Drawing Sheets

ELEVATED BRIDGE INFRASTRUCTURE DESIGN METHOD

BACKGROUND OF THE INVENTION

The present invention relates to an elevated bridge, particularly to a railway elevated bridge infrastructure and the design method thereof.

Moreover, the present invention relates to a seismic reinforcement process for reinforcing a reinforced concrete (RC) member in which shear failure precedes bending failure against earthquakes.

Furthermore, the present invention relates to a seismic frame structure requiring seismic properties and the design method thereof, particularly to a seismic frame structure and design method which are applied to the infrastructure of an elevated bridge for use in roads, railways, and the like.

A bridge on which railways, and transport vehicles such as cars run includes a bridge crossing rivers, straits, and the like in a narrow sense, and also includes a so-called elevated bridge continuously constructed in the streets. Such elevated bridge is continuously constructed on the road, the railway, or the space over the river from the viewpoint of efficient land utilization, and the road or the railway under the elevated bridge is three-dimensionally crossed, which also contributes to the relief of traffic jams.

Additionally, such elevated bridge infrastructure is usually constructed as a rigid frame structure of a reinforced concrete (RC) in many cases, but during design/construction, of course, the soundness of the elevated bridge itself during an earthquake, and also the safety of the running transport vehicle have to be sufficiently studied.

Under the circumstances, the present applicants have proposed an elevated bridge infrastructure in which a damper-brace is disposed in the rigid frame of the reinforced concrete, and it has been found that both the seismic property and the running safety can be enhanced according to the constitution.

However, no seismic design method has been established, and the development of a design technique which can efficiently and economically secure the seismic property and running safety has been desired.

Moreover, different from the bending failure, the shear failure of an RC member rapidly advances due to lack of ductility, and brings a fatal damage to the structure in many cases. Particularly, the shear failure of a pillar material caused by the action of a seismic load causes large damage to the structure in many cases, and for a short pillar which has a small shear span ratio and onto which a large axial force acts, and the like, the concrete of a pillar core part bursts into destruction by the compound action of a large axial direction stress and shear stress, and the pillar rapidly loses its load bearing capacity.

Therefore, in the structure design, the shear failure has to be avoided to the utmost, and for the current RC member in which the shear failure possibly precedes bending failure, seismic reinforcement is necessary, such as the winding of carbon fibers around a periphery and the winding of steel plates.

In this method, it is possible to enhance the shear load bearing capacity of an RC member and prevent the shear failure beforehand, but on the other hand, since the carbon fiber has to be wound over the entire member length, construction requires much time, and the method cannot necessarily be optimum as the seismic reinforcement process from an economical point of view.

Moreover, the infrastructure of the elevated bridge in which the damper-brace is disposed in the RC rigid frame is expected in the future because the seismic property can be enhanced as described above. However, when a steel frame eccentric brace is disposed in the RC rigid frame and a damper is interposed between the steel frame eccentric brace and the RC rigid frame, and when the damper has a small allowable deformation amount, such as a hysteresis shear damper, the damper is first ruptured in a big earthquake, and there has been a problem in that the ductility of the RC rigid frame cannot sufficiently be utilized.

Furthermore, when the damper is ruptured with a relatively small deformation, the load bearing capacity of the damper or the RC rigid frame has to be increased, but in this case, a foundation and a pile are naturally required to have a load bearing capacity increase, and consequently, the entire structure has a large section, which has caused a cost problem.

SUMMARY OF THE INVENTION

Accordingly, it is an object of the present invention to provide an elevated bridge infrastructure and the design method thereof in which the seismic property and running safety can more efficiently and economically be secured.

It is a further object of the present invention to provide a seismic reinforcement process of an RC frame in which shear failure can be prevented beforehand without requiring much construction time.

It is another object of the present invention to provide a seismic frame structure and the design method thereof which can enhance the seismic property without providing a damper or an RC rigid frame with a large section.

With the foregoing object in view, the present invention provides a method for designing an elevated bridge infrastructure that includes an RC rigid frame and a damper-brace disposed in a structural plane. The method comprises the steps of: setting a target ductility factor $\mu_d$ and a target natural period $T_d$ for the infrastructure in an assumed earthquake motion; obtaining a yield seismic coefficient corresponding to the target ductility factor $\mu_d$ and the target natural period $T_d$ from a yield seismic coefficient spectrum corresponding to the assumed earthquake motion to provide a design seismic coefficient $K_h$, and obtaining a target yield rigidity $K_d$ corresponding to the target natural period $T_d$; using the design seismic coefficient $K_h$ to obtain a design horizontal load bearing capacity $H_d$ and obtaining a displacement corresponding to the design horizontal load bearing capacity $H_d$ as a design yield displacement $\delta_d$ from the target yield rigidity $K_d$; distributing the design horizontal load bearing capacity $H_d$ to a horizontal force $H_f$ to be borne by the RC rigid frame and a horizontal force $H_b$ to be borne by the damper-brace; and setting member sections of the RC rigid frame and the damper-brace so that the RC rigid frame and the damper-brace resist the horizontal forces $H_f$, $H_b$ with an ultimate load bearing capacity, and displacements corresponding to the horizontal forces $H_f$, $H_b$ equal a product of the design yield displacement $\delta_d$ and the target ductility factor $\mu_d$.

Here, by performing the steps until setting the member sections of the RC rigid frame and the damper-brace as described above, the section design of the elevated bridge infrastructure is completed once, but subsequently the set member sections may be checked.

The present invention also provides an elevated bridge infrastructure comprising an RC rigid frame and a damper-brace disposed in a structural plane, wherein member sections of the RC rigid frame and the damper-brace are set by setting a target ductility factor $\mu_d$ and a target national period $T_d$ of the infrastructure in an assumed earthquake motion, obtaining is a yield seismic coefficient corresponding to the target ductility factor $\mu_d$ and the target natural period $T_d$ from a yield seismic coefficient spectrum corresponding to the assumed earthquake motion to provide a design seismic coefficient $K_h$, obtaining a target yield rigidity $K_d$ corresponding to the target natural period $T_d$, using the seismic coefficient $K_h$ to obtain a design horizontal load bearing capacity $H_d$, obtaining a displacement corresponding to the design horizontal load bearing capacity $H_d$ as a design yield displacement $\delta_d$ from the target yield rigidity $K_d$, and distributing the design horizontal load bearing capacity $H_d$ to a horizontal force $H_f$ to be borne by the RC rigid frame and a horizontal force $H_b$ to be borne by the damper-brace, so that the RC rigid frame and the damper-brace resist the horizontal forces $H_f$, $H_b$ with an ultimate load bearing capacity and displacements corresponding to the horizontal forces $H_f$, $H_b$ equal a product of the design yield displacement $\delta_d$ and the target ductility factor $\mu_d$.

Here, by performing the steps until setting the member sections of the RC rigid frame and the damper-brace as described above, the section design of the elevated bridge infrastructure is completed once, but subsequently the set member sections may be checked.

The present invention further provides a method for designing an elevated bridge infrastructure that includes an RC rigid frame and a damper-brace disposed in a structural plane. The method comprises the steps of: setting a target ductility factor $\mu_d$ and a target natural period $T_d$ for the infrastructure in an assumed earthquake motion; obtaining an elastic response spectrum seismic coefficient corresponding to the target natural period $T_d$ from an elastic response spectrum corresponding to the assumed earthquake motion; applying the elastic response spectrum seismic coefficient and the target ductility factor $\mu_d$ to Newmark's rule of constant potential energy to calculate a design seismic coefficient $K_h$ and obtaining a target yield rigidity $K_d$ corresponding to the target natural period $T_d$; using the design seismic coefficient $K_h$ to obtain a design horizontal load bearing capacity $H_d$ and obtaining a displacement corresponding to the design horizontal load bearing capacity $H_d$ as a design yield displacement $\delta_d$ from the target yield rigidity $K_d$; distributing the design horizontal load bearing capacity $H_d$ to a horizontal force $H_f$ to be borne by the RC rigid frame and a horizontal force $H_b$ to be borne by the damper-brace; and setting member sections of the RC rigid frame and the damper-brace so that the RC rigid frame and the damper-brace resist the horizontal forces $H_f$, $H_b$ with an ultimate load bearing capacity, and displacements corresponding to the horizontal forces $H_f$, $H_b$ equal a product of the design yield displacement $\delta_d$ and the target ductility factor $\mu_d$.

Here, by performing the steps until setting the member sections of the RC rigid frame and the damper-brace as described above, the section design of the elevated bridge infrastructure is completed once, but subsequently the set member sections may be checked.

The present invention further provides an elevated bridge infrastructure comprising an RC rigid frame and a damper-brace disposed in a structural plane, wherein member sections of the RC rigid frame and the damper-brace are set by setting a target ductility factor $\mu_d$ and a target natural period $T_d$ of the infrastructure in an assumed earthquake motion, obtaining an elastic response spectrum seismic coefficient corresponding to the target natural period $T_d$ from an elastic response spectrum corresponding to the assumed earthquake motion, applying the elastic response spectrum seismic coefficient and the target ductility factor $T_d$ to Newmark's rule of constant potential energy to calculate a design seismic coefficient $K_h$, obtaining a target yield rigidity $K_d$ corresponding to the target natural period $T_d$, using the design seismic coefficient $K_h$ to obtain a design horizontal load bearing capacity $H_d$, obtaining is a displacement corresponding to the design horizontal load bearing capacity $H_d$ as a design yield displacement $\delta_d$ from the target yield rigidity $K_d$, and distributing the design horizontal load bearing capacity $H_d$ to a horizontal force $H_f$ to be borne by the RC rigid frame and a horizontal force $H_b$ to be borne by the damper-brace, so that the RC rigid frame and the damper-brace resist the horizontal forces $H_f$, $H_b$ with an ultimate load bearing capacity and displacements corresponding to the horizontal forces $H_f$, $H_b$ equal a product of the design yield displacement $\delta_d$ and the target ductility factor $\mu_d$.

Here, by performing the steps until setting the member sections of the RC rigid frame and the damper-brace as described above, the section design of the elevated bridge infrastructure is completed once, but subsequently the set member sections may be checked.

The present invention further provides a method for designing an elevated bridge infrastructure that includes an RC rigid frame and a damper-brace disposed in a structure plane. The method comprises the steps of: setting a target ductility factor $\mu_d$ and a target natural period $T_d$ for the infrastructure in an assumed earthquake motion; obtaining an elastic response spectrum seismic coefficient corresponding to the target natural period $T_d$ from an elastic response spectrum corresponding to the assumed earthquake motion; dividing the elastic response spectrum seismic coefficient by a response modification factor determined by a structure type to calculate a design seismic coefficient $k_h$, and obtaining a target yield rigidity $K_d$ corresponding to the target natural period $T_d$; using the design seismic coefficient $K_h$ to obtain a design horizontal load bearing capacity $H_d$ and obtaining a displacement corresponding to the design horizontal load bearing capacity $H_d$ as a design yield displacement $\delta_d$ from the target yield rigidity $K_d$; distributing the design horizontal load bearing capacity $H_d$ to a horizontal force $H_f$ to be borne by the RC rigid frame and a horizontal force $H_b$ to be borne by the damper-brace; and setting member sections of the RC rigid frame and the damper-brace so that the RC rigid frame and the damper-brace resist the horizontal forces $H_f$, $H_b$ with an ultimate load bearing capacity, and displacements corresponding to the horizontal forces $H_f$, $H_b$ equal a product of the design yield displacement $\delta_d$ and the target ductility factor $\mu_d$.

Here, by performing the steps until setting the member sections of the RC rigid frame and the damper-brace as described above, the section design of the elevated bridge infrastructure is completed once, but subsequently the set member sections may be checked.

The present invention further provides an elevated bridge infrastructure comprising an RC rigid frame and a damper-brace disposed in a structural plane, wherein member sections of the RC rigid frame and the damper-brace are set by setting a target ductility factor $\mu_d$ and a target natural period $T_d$ of the infrastructure in an assumed earthquake motion, obtaining an elastic response spectrum seismic coefficient corresponding to the target natural period $T_d$ from an elastic response spectrum corresponding to the assumed earthquake motion, dividing the elastic response spectrum seismic coefficient by a response modification factor determined by a structure type to calculate a design seismic coefficient $k_h$, obtaining a target yield rigidity $K_d$ corresponding to the target natural period $T_d$, using the design seismic coefficient $K_h$ to obtain a design horizontal load bearing capacity $H_d$, obtaining a displacement corresponding to the design horizontal load bearing capacity $H_d$ as a design yield displacement $\delta_d$ from the target yield rigidity $K_d$, and distributing the design horizontal load bearing capacity $H_d$ to a horizontal force $H_f$ to be borne by the RC rigid frame and a horizontal force $H_b$ to be borne by the damper-brace, so that the RC rigid frame and the damper-brace resist the horizontal forces $H_f$, $H_b$ with an ultimate load bearing capacity and the displacements corresponding to the horizontal forces $H_f$, $H_b$ equal a product of the design yield displacement $\delta_d$ and the target ductility factor $\mu_d$.

Here, by performing the steps until setting the member sections of the RC rigid frame and the damper-brace as described above, the section design of the elevated bridge infrastructure is completed once, but subsequently the set member sections may be checked.

As the infrastructure of the elevated bridge, the infrastructure comprising the RC rigid frame and the damper-brace disposed in the structural plane is considered. However, the damper-brace mentioned herein means a structure including a brace disposed in the structural plane of the RC rigid frame and a hysteresis damper interposed between the brace and the RC rigid frame, in the brace or between braces, and brace shapes such as Y, X and K types and the hysteresis damper types such as shear and bending types, are arbitrary. Moreover, the constitution of the RC rigid frame is also arbitrary, and for example, the presence/absence of a foundation beam is not limiting.

Moreover, the present invention is mainly applied to a railway elevated bridge, but its use is arbitrary, and a highway elevated bridge is also included.

The present invention further provides a seismic reinforcement process of an RC frame comprising the steps of: partially cutting a main reinforcement bar of an RC member to shift failure property of the RC member from a shear failure preceding type to a bending failure preceding type.

The present invention further provides a seismic reinforcement process of an RC frame comprising the steps of: partially cutting a main reinforcement bar of an RC pillar member constituting an RC rigid frame to shift failure property of the RC member from a shear failure preceding type to a bending failure preceding type; and attaching a damper-brace mechanism in a plane of the RC rigid frame.

The present invention further provides a seismic frame structure comprising: an RC rigid frame including a pair of pillars vertically disposed in positions opposite to each other and a beam extended between tops of the pillars; an inverse V-shaped or V-shaped eccentric brace material disposed in a structural plane of the RC rigid frame and having both ends pin-connected to vicinities of middle positions of the pillars; and a damper interposed between an upper end of the inverse V-shaped eccentric brace material and the beam or between a lower end of the V-shaped eccentric brace material and a foundation beam for connecting leg parts of the pillars.

The present invention further provides a design method for a seismic frame structure that includes an RC rigid frame including a pair of pillars vertically disposed in positions opposite to each other and a beam extended between tops of the pillars, an inverse V-shaped eccentric brace material disposed in a structural plane of the RC rigid frame and having both ends pin-connected to vicinities of middle positions of the pillars, and a damper interposed between an upper end of the inverse V-shaped eccentric brace material and the beam. The method comprises the steps of:

modeling the seismic frame structure by disassembling the seismic frame structure into two models, i.e. an RC analysis model obtained by replacing a rigid joint of the RC rigid frame with a rotational spring and a damper-brace analysis model obtained by replacing the pillar and the beam with a virtual rigid pillar and a virtual rigid beam, pin-connecting the virtual rigid pillar to the virtual rigid beam, and interposing the damper between the virtual rigid beam and the upper end of the eccentric brace material;

in design of an external force P to be exerted to the seismic frame structure, obtaining a load $P_{db}$ of the damper-brace analysis model from the following equation, $$P_{db}=(h'/h)H_b$$

in which h' denotes a height from a leg part of the virtual rigid pillar to the virtual rigid beam, h' denotes a height from a brace connecting position of the virtual rigid pillar to the virtual rigid beam, and $H_b$ denotes a damper load displacement characteristic, and obtaining a load $P_{rc}$ of the RC analysis model from the following equation, $$P_{rc}=P-P_{db};$$

and exerting $P_{db}$ to the damper-brace analysis model, exerting $P_{rc}$ to the RC analysis model to perform individual elasto-plastic analyses, and performing a section design of the seismic frame structure.

The site to which the seismic framework structure according the present invention is to be applied is arbitrary, and the present invention may be applied, for example, to a building seismic wall, or a bridge pier as the elevated bridge infrastructure. Additionally, the elevated bridge conceptually includes elevated bridges for railways, highways, and the like, and needless to say, its use is arbitrary.

A steel frame brace material can mainly be employed as the eccentric brace material.

For the damper, a hysteresis shear damper constituted from an excessively soft steel, a slitted thin steel plate, or the like is typically used, but a damper of any principle or structure may be used as long as a damping is generated by relative horizontal deformation and the sufficient deformation cannot be secured. A hysteresis bending damper, and the like can also be employed.

When both ends of the eccentric brace material are pinned to certain places of the pillars, "the vicinity of the middle position" of the present invention means an appropriate position between the pillar leg part and head part excluding these parts, and is not limited to a pillar bisector point, and the setting of (h'/h) is a matter of design.

BRIEF DESCRIPTION OF THE DRAWINGS

The above and other objects, features and advantages of the present invention will become more apparent from the following description taken in connection with the accompanying drawings, in which

FIGS. 17A–17C are diagrams showing an effect of the seismic reinforcement process of the RC frame according to the present invention, wherein FIG. 17A shows a restoring force characteristic in the RC rigid frame alone, FIG. 17B shows the restoring force characteristic of the damper-brace mechanism alone, and FIG. 17C shows the entire restoring force characteristic;

DESCRIPTION OF THE PREFERRED EMBODIMENTS

Figure 1:
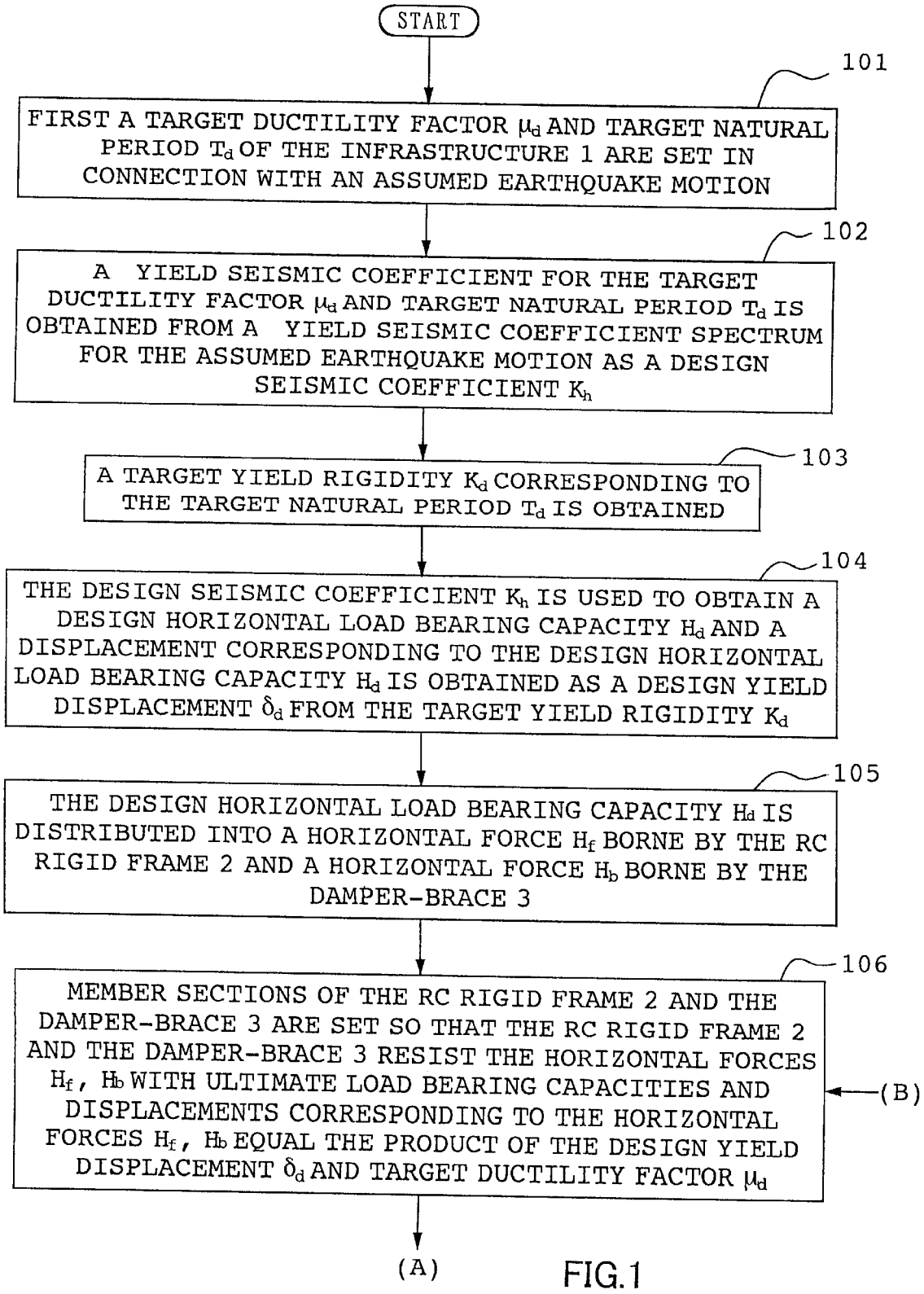
FIG. 1 is a flowchart showing the design method of an elevated bridge infrastructure in a first embodiment according to the present invention.
Figure 2:
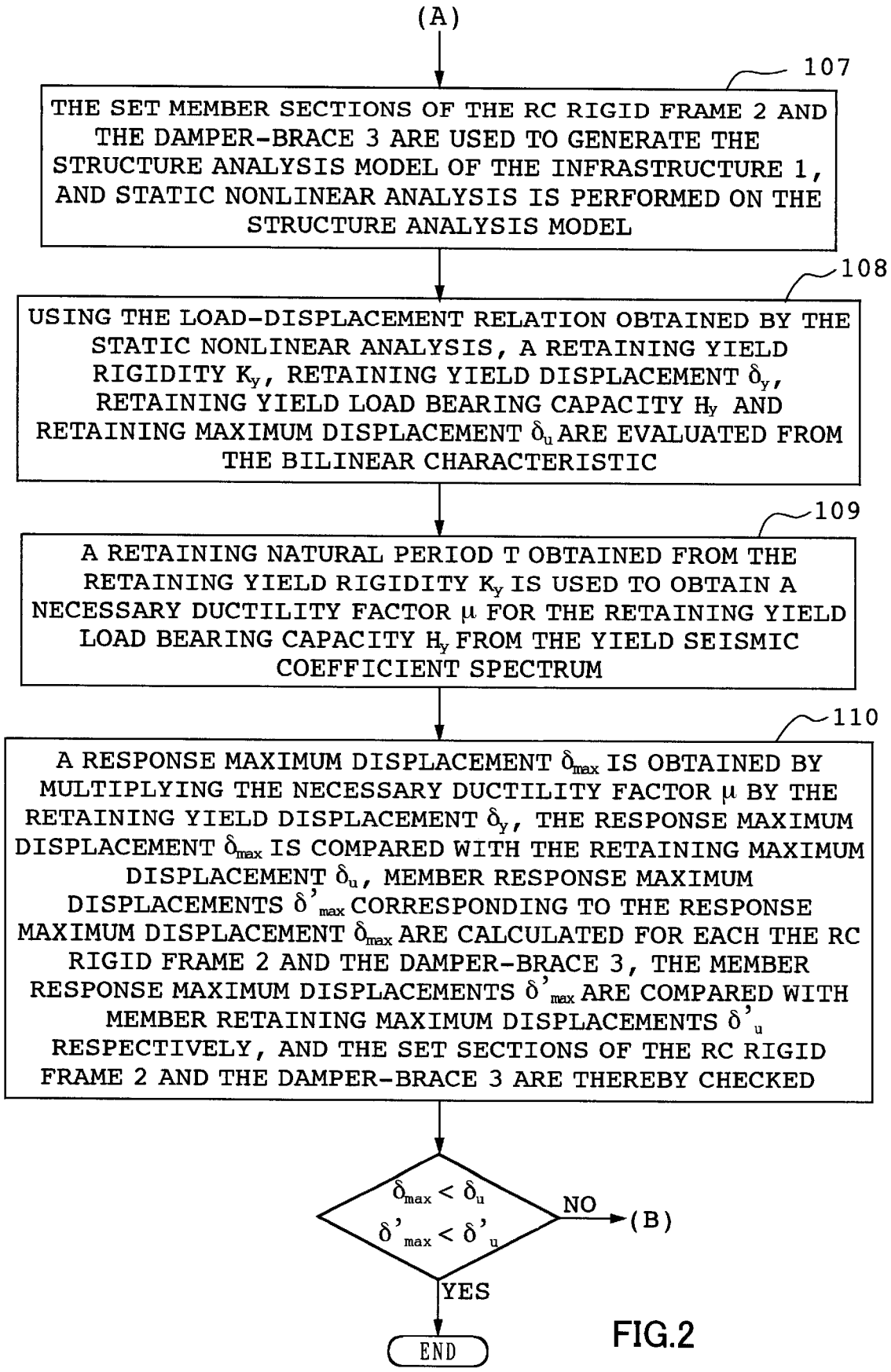
FIG. 2 is similarly a flowchart showing the design method of the elevated bridge infrastructure in the first embodiment.
Figure 3:
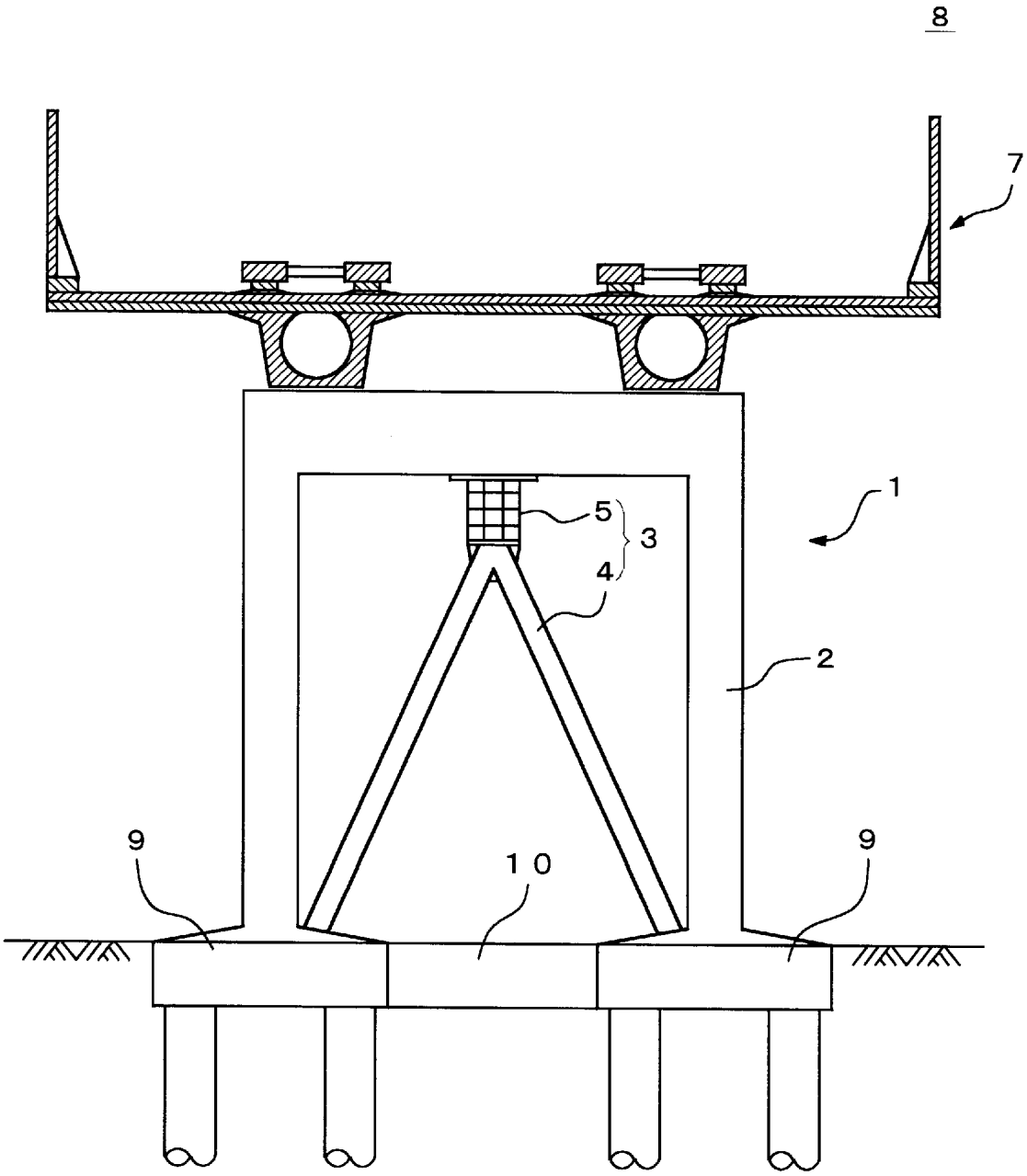
FIG. 3 is a front view of the elevated bridge infrastructure as seen from abridge axial direction according to the present invention.

FIGS. 1 and 2 are flowcharts showing the flow of the design method of an elevated bridge infrastructure in a first embodiment according to the present invention, and FIG. 3 is a front view of an elevated bridge infrastructure 1 as seen from a bridge axial direction designed/constructed from such design method.

As shown in FIG. 3, the infrastructure 1 of the elevated bridge is constituted of a reinforced concrete rigid frame 2 hereinafter RC rigid frame 2 and a damper-brace 3 disposed in a structural plane. The damper-brace 3 is provided with an inverted V-shaped steel frame brace 4 disposed in the structural plane of the reinforced concrete rigid frame 2, and a hysteresis damper 5 connecting the top of the steel frame brace 4 to the under surface of the middle of the beam of the RC rigid frame 2. Moreover, a superstructure 7 constituted of a bridge girder, and the like is extended above the infrastructure 1, and the infrastructure 1 and superstructure 7 constitute a railway elevated bridge 8.

Additionally, when a required horizontal rigidity can be secured by disposing the damper-brace 3, a foundation beam 10 for connecting footings 9, 9 formed on leg parts of the RC rigid frame 2 may be omitted. The omission of the foundation beam 10 can remarkably reduce the construction cost of the infrastructure 1.

In order to design the infrastructure 1 of the elevated bridge, as shown in the flowcharts of FIGS. 1 and 2, first a target ductility factor $\mu_d$ and target natural period $T_d$ for the infrastructure 1 are set in connection with an assumed earthquake motion (step 101).

Specifically, the target values of the ductility factor and natural period of the infrastructure 1 when the assumed earthquake motion is received are set as the target ductility factor $\mu_d$ and target natural period $T_d$, respectively.

Here, as the assumed earthquake motion, for example, a huge earthquake which occurs substantially once in the use period of the infrastructure 1 can be considered. Moreover, the target ductility factor $\mu_d$ can be set to $\mu$=about 3.0, for example, from the property of the damper-brace 3, and the target natural period $T_d$ can be set to $T_d$=about 0.5 second, for example, from the viewpoint of the railway running safety. Additionally, as described above, the assumed earthquake motion described herein includes the influence of a surface ground layer.

Figure 4:
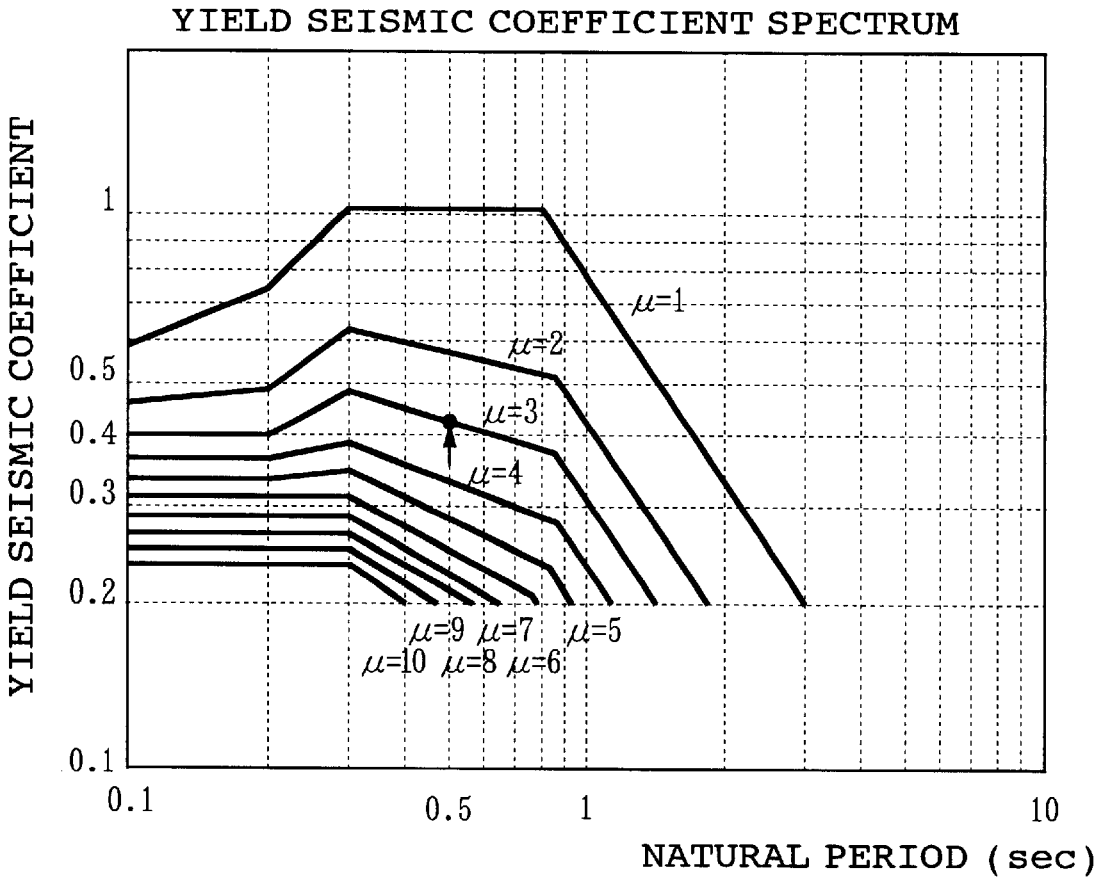
FIG. 4 is a graph showing a yield seismic coefficient spectrum.

Subsequently, a yield seismic coefficient for the target ductility factor $\mu_d$ and target natural period $T_d$ is obtained from a yield seismic coefficient spectrum for the assumed earthquake motion as a design seismic coefficient $K_h$ (step 102). FIG. 4 shows the yield seismic coefficient spectrum.

For the yield seismic coefficient spectrum, since the maximum action horizontal force when the assumed earthquake motion is inputted to a vibration system having an arbitrary yield load bearing capacity is calculated using a ductility factor $\mu$=1, 2, 3 . . . as a parameter, and the calculation result is divided by a weight in a dimensionless manner and plotted as the yield seismic coefficient, by associating the target ductility factor $\mu_d$ and target natural period $T_d$ with the ductility factor as the parameter of the yield seismic coefficient spectrum and the natural period of the abscissa, respectively, a value on the ordinate can be read as the yield seismic coefficient. Specifically, referring to FIG. 4, for example, the target ductility factor $\mu_d$ indicates 3 and the target natural period $T_d$ indicates 0.5 second in a place shown by a circle mark of FIG. 4, the yield seismic coefficient is about 0.44, and the design seismic coefficient $K_h$ therefore indicates 0.44.

On the other hand, a target yield rigidity $K_d$ corresponding to the target natural period $T_d$ is obtained (step 103). The target yield rigidity $K_d$ can be calculated from $K_d=(2\pi/T)^2W/g$ (g; gravitational acceleration) using the effective weight W of the infrastructure 1.

Subsequently, the design seismic coefficient $K_h$ is used to obtain a design horizontal load bearing capacity $H_d$ and a displacement corresponding to the design horizontal load bearing capacity $H_d$ is obtained as a design yield displacement $\delta_d$ from the target yield rigidity $K_d$ (step 104). The design horizontal load bearing capacity $H_d$ can be calculated by multiplying the design seismic coefficient $K_h$ by the effective weight W of the infrastructure 1, that is, as $H_d=WK_h$. Moreover, the design yield displacement $\delta_d$ is calculated by dividing the design horizontal load bearing capacity $H_d$ by the target yield rigidity $K_d$, that is, as $\delta_d=H_d/K_d$.

Subsequently, the design horizontal load bearing capacity $H_d$ is distributed into a horizontal force $H_f$ to be borne by the RC rigid frame 2 and a horizontal force $H_b$ to be borne by the damper-brace 3 (step 105). Here, the distribution may be performed with an arbitrary ratio.

Figure 5:
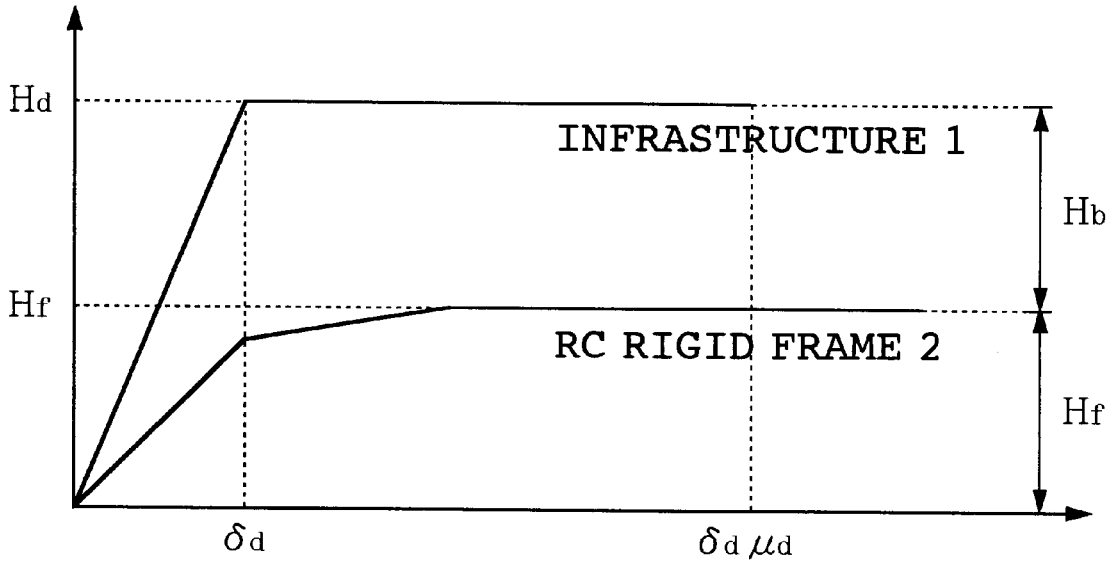
FIG. 5 is a graph showing the horizontal force and deformation performance of an RC rigid frame and a damper-brace.

Next, member sections of the RC rigid frame 2 and the damper-brace 3 are set so that the RC rigid frame 2 and the damper-brace 3 resist the horizontal forces $H_f$, $H_b$ with ultimate load bearing capacities and displacements corresponding to the horizontal forces $H_f$, $H_b$ equal the product of the design yield displacement $\delta_d$ and target ductility factor $\mu_d$, that is, $\delta_d\mu_d$ (step 106). FIG. 5 shows the correlation of H, $H_f$, $H_b$, $\delta_d$, $\mu_d$, and $\delta_d\mu_d$.

The setting of the member sections will concretely be described with respect to the RC rigid frame 2. First, a pillar section size is determined so that the design yield displacement $\delta_d$ is generated when the horizontal force $H_f$ acts on the RC rigid frame 2. Subsequently, the steel reinforcement amount of shear reinforcement bars is determined so that the deformation performance exceeds $\delta_d\mu_d$. Moreover, in order to determine the steel reinforcement amount (steel reinforcement amount of main reinforcement bars) of the pillar of the RC rigid frame 2, not a pillar bend yield load bearing capacity, but a bend ultimate load bearing capacity is used.

On the other hand, for the damper-brace 3, the member section may be set so that the damper-brace 3 resists the horizontal force $H_b$ with the ultimate load bearing capacity and the displacement corresponding to the force equals the product of the design yield displacement $\delta_d$ and target ductility factor $\mu_d$, that is, $\delta_d\mu_d$. Additionally, the hysteresis damper 5 constituting the damper-brace 3 can be constituted, for example, as a shear type damper formed of a low yield point steel.

Subsequently, the set member sections of the RC rigid frame 2 and the damper-brace 3 are used to generate the structure analysis model of the infrastructure 1, and static nonlinear analysis is performed on the structure analysis model (step 107).

Figure 6:
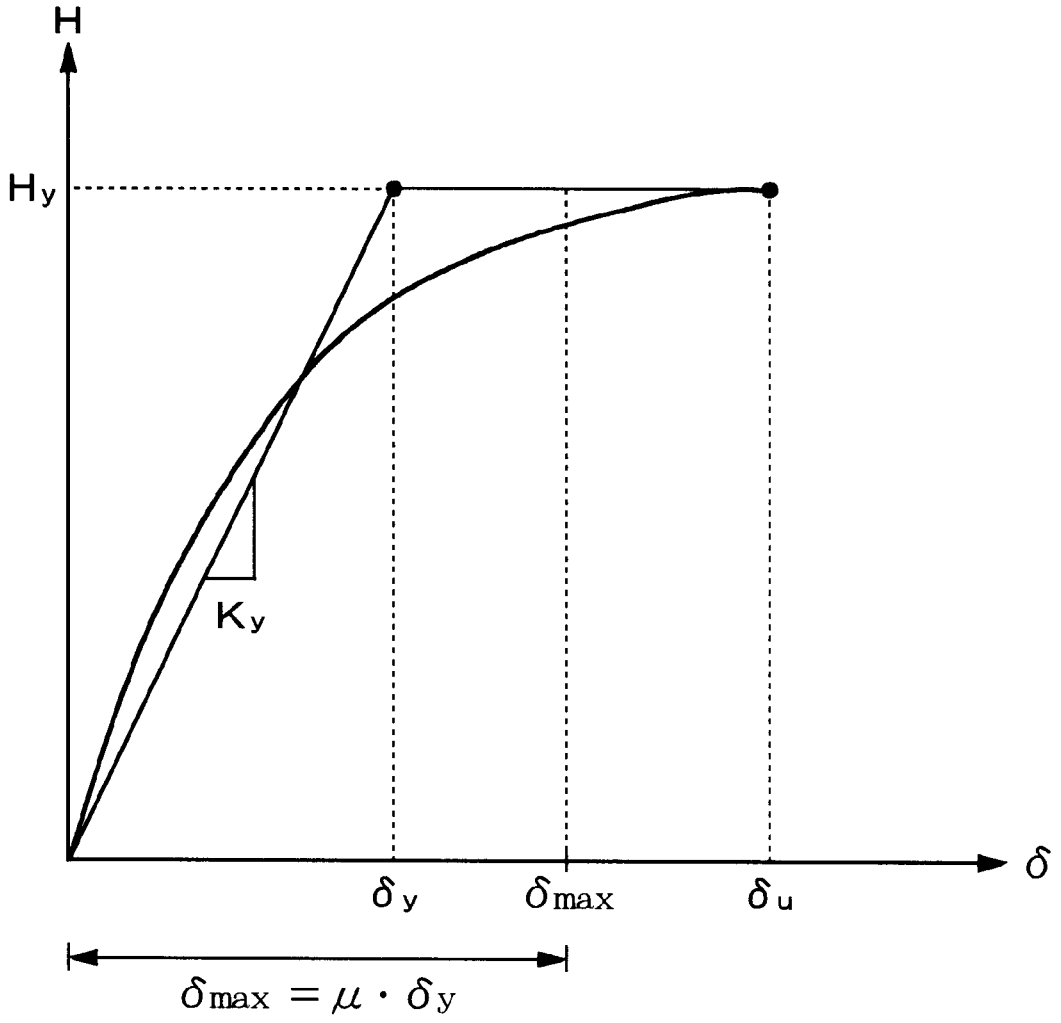
FIG. 6 is a graph showing a load-displacement relationship obtained by a static nonlinear analysis.

Subsequently, the load-displacement relationship of FIG. 6 obtained by the static nonlinear analysis is replaced with a bilinear characteristic as shown in FIG. 6, and a retaining yield rigidity $K_y$, retaining yield displacement $\delta_y$, retaining yield load bearing capacity $H_y$ and retaining maximum displacement $\delta_u$ are evaluated from the bilinear characteristic (step 108).

Subsequently, a retaining natural period T obtained from the retaining yield rigidity $K_y$ is used to obtain a necessary ductility factor $\mu$ for the retaining yield load bearing capacity $H_y$ from the yield seismic coefficient spectrum (step 109). For the calculation of the necessary ductility factor $\mu$, the spectrum curve satisfying the retaining natural period T and retaining yield load bearing capacity $H_y$ is selected, and the ductility factor of the spectrum curve may be used as the necessary ductility factor $\mu$ (see FIG. 4).

Subsequently, a response maximum displacement $\delta_{max}$ is obtained by multiplying the necessary ductility factor $\mu$ by the retaining yield displacement $\delta_y$, the response maximum displacement $\delta_{max}$ is compared with the retaining maximum displacement $\delta_u$, member response maximum displacements $\delta'_{max}$ corresponding to the response maximum displacement $\delta_{max}$ are calculated for each of the RC rigid frame 2 and the damper-brace 3, the member response maximum displacements $\delta'_{max}$ are compared with member retaining maximum displacements $\delta'_u$, respectively, and the set sections of the RC rigid frame 2 and the damper-brace 3 are thereby checked (step 110). Subsequently, when the condition $\delta_{max}<\delta_u$, $\delta'_{max}<\delta'_u$ is satisfied, the design is ended, and when the condition is not satisfied, the design returns to the step 106 to perform the section calculation again, and then the steps 106 to 110 are repeatedly performed until the above-described condition is satisfied.

As described above, according to the elevated bridge infrastructure 1 and design method of the present embodiment, since the design horizontal load bearing capacity $H_d$ is distributed as the horizontal forces $H_f$, $H_b$ to the RC rigid frame 2 and the damper-brace 3, for the setting of the member sections of the RC rigid frame 2 and the damper-brace 3, it is sufficient to individually perform the settings for the distributed horizontal forces $H_f$, $H_b$, and it is possible to easily perform the section design.

This is on the assumption that the resistance against the horizontal force acting on the entire infrastructure 1 can be represented as the overlapped ultimate load bearing capacities of the RC rigid frame 2 and the damper-brace 3, but in the conventional seismic design of the constructed structure, it is not recognized that such overlapping principle can be applied to the elasto-plastic design of the mixed structure of reinforced concrete and steel as it is. Such mixed structure has not been originally present in the construction field, and the method itself of the elasto-plastic design with respect to the mixed structure has not been established in the present situation.

However, in the present embodiment, by assuming that the overlapping exists, distributing the entire horizontal force to the RC rigid frame 2 and the damper-brace 3, and individually performing the section settings, the set sections become remarkably reasonable, and this has been confirmed by the present applicants through many experiments and simulation analyses.

Moreover, according to the elevated bridge infrastructure 1 and design method of the present embodiment, since the member section calculation is performed on the basis of not the yield load bearing capacity, but the ultimate load bearing capacity, the economical section design can be realized without repeating the member section calculation.

Specifically, when the section design is performed on the basis of the yield load bearing capacity by considering the matching property with the use of the yield seismic coefficient spectrum, an excessively safe result is produced, and the section setting is obliged to be repeated many times in order to obtain an economical result.

However, it has been confirmed through many experiments and simulation analyses of the applicants that the set sections become remarkably reasonable as a result, by assuming that the overlapping exists as described above, distributing the entire horizontal force to the RC rigid frame 2 and the damper-brace 3, and performing each section setting with the ultimate load bearing capacity. Moreover, in most cases, it is unnecessary to set the member section again, and the check of the member section in the step 110 can clearly be performed once by calculating the member section in accordance with the steps 101 to 106.

Therefore, according to the present embodiment, it is possible to easily obtain the member sections of the RC rigid frame 2 and the damper-brace 3 while sufficiently utilizing the ductility without performing many repetitions, and it is therefore possible to remarkably reduce the design cost and construction cost of the elevated bridge infrastructure 1.

In the present embodiment, the set member sections are checked in the steps 107 to 110, but by calculating the member sections in the steps 101 to 106 as described above, the check of the member sections in the step 110 can clearly be performed only once in many cases. Therefore, such check steps may be omitted as occasion demands. Even in the constitution, the similar action/effect as described above can be obtained with respect to the setting of the member sections.

Moreover, in the present embodiment, the example of the structural plane of the RC rigid frame crossing at right angles to the bridge axis has been described, but needless to say, the present invention can even be applied to the RC rigid frame along the bridge axis and the damper-brace disposed in the structural plane.

Figure 7:
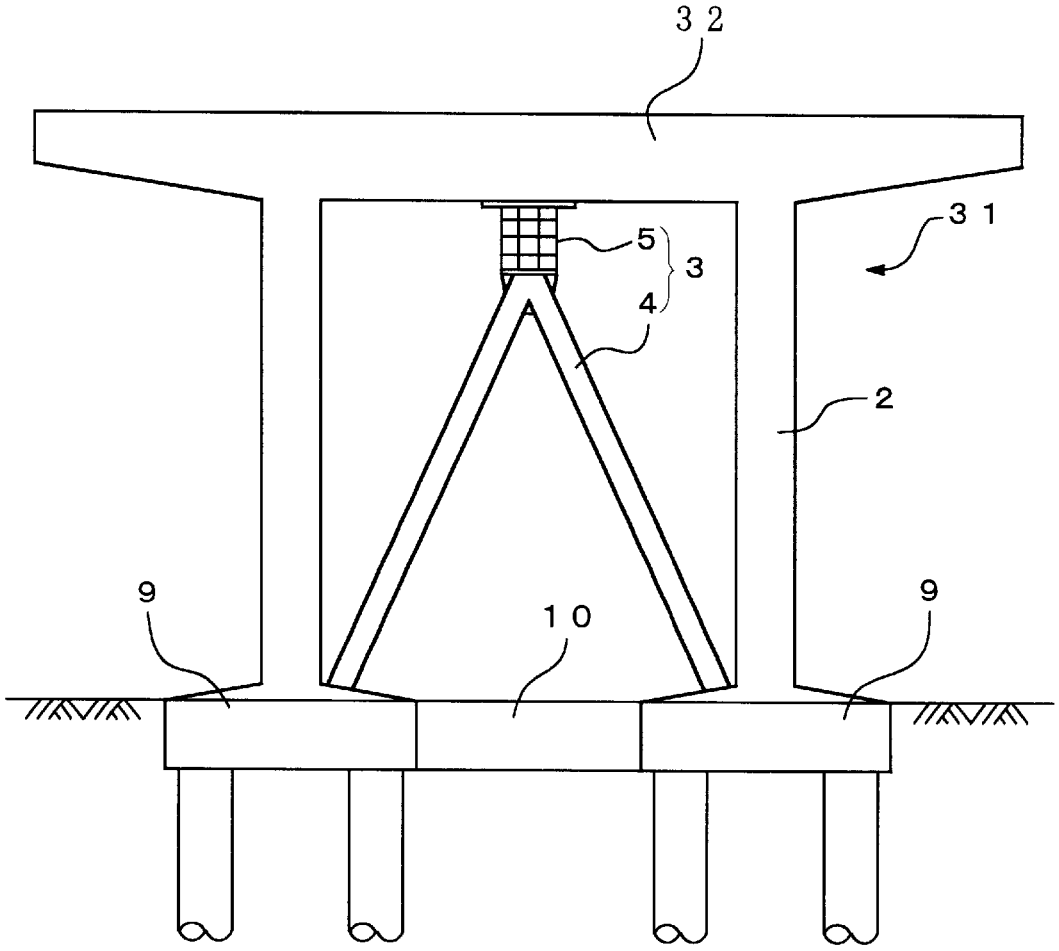
FIG. 7 is a front view of the elevated bridge infrastructure as seen from the bridge axial direction according to a modified example.

Furthermore, in the present embodiment, the railway elevated bridge 8 constituted by the infrastructure 1 and superstructure 2 has been described as the example, but the combination of the elevated bridge infrastructure of the present invention with the superstructure is arbitrary. The superstructure 2 is not limited as shown in FIG. 3, and an infrastructure 31 of a type (beam slab type) in which a beam 32 is used as a superstructure slab may be used as shown in FIG. 7.

A second embodiment will next be described. Additionally, substantially the same components as those of the first embodiment are denoted with the same reference numerals and the description thereof is omitted.

Figure 8:
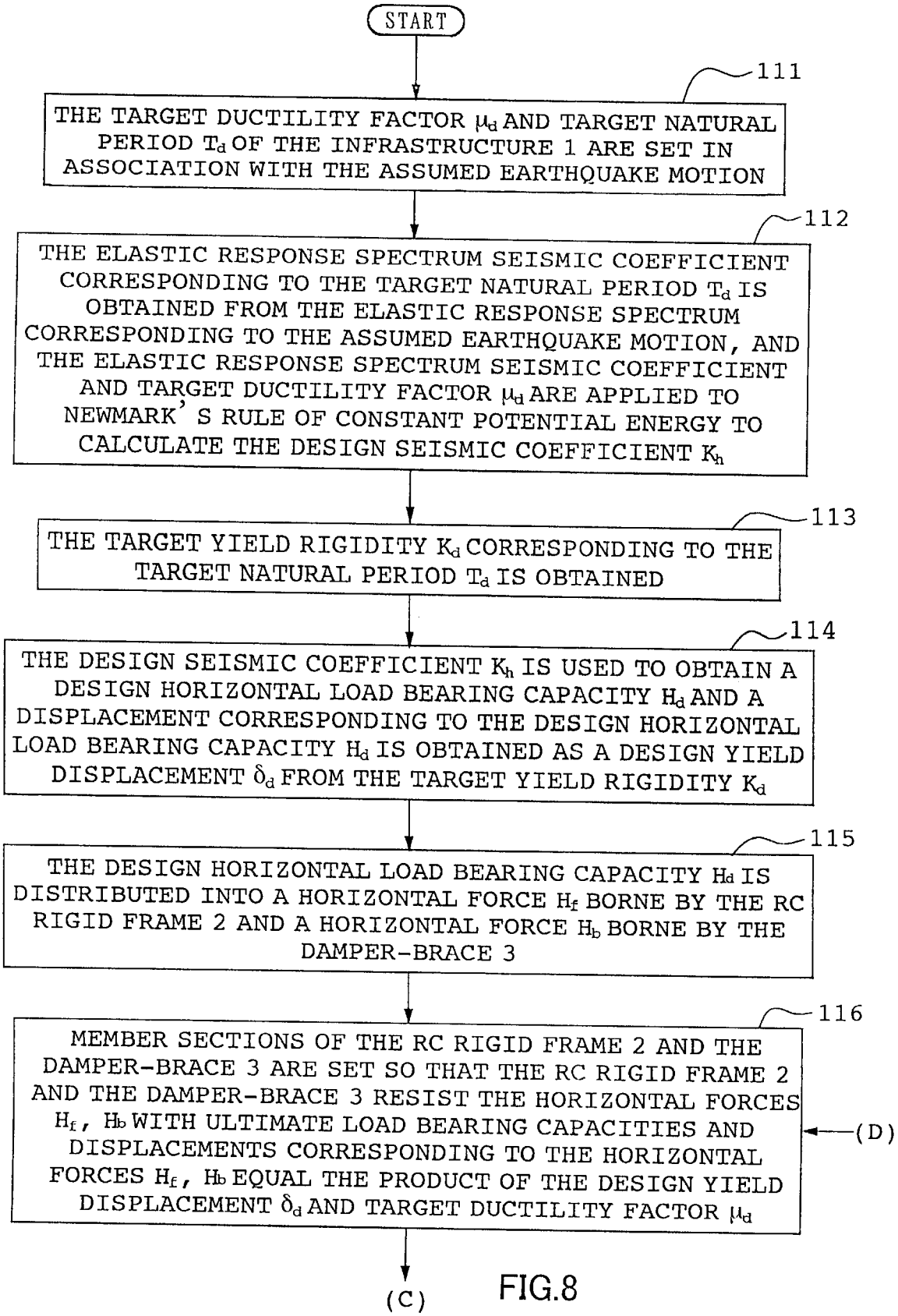
FIG. 8 is a flowchart showing the design method of an elevated bridge infrastructure in a second embodiment according to the present invention.
Figure 9:
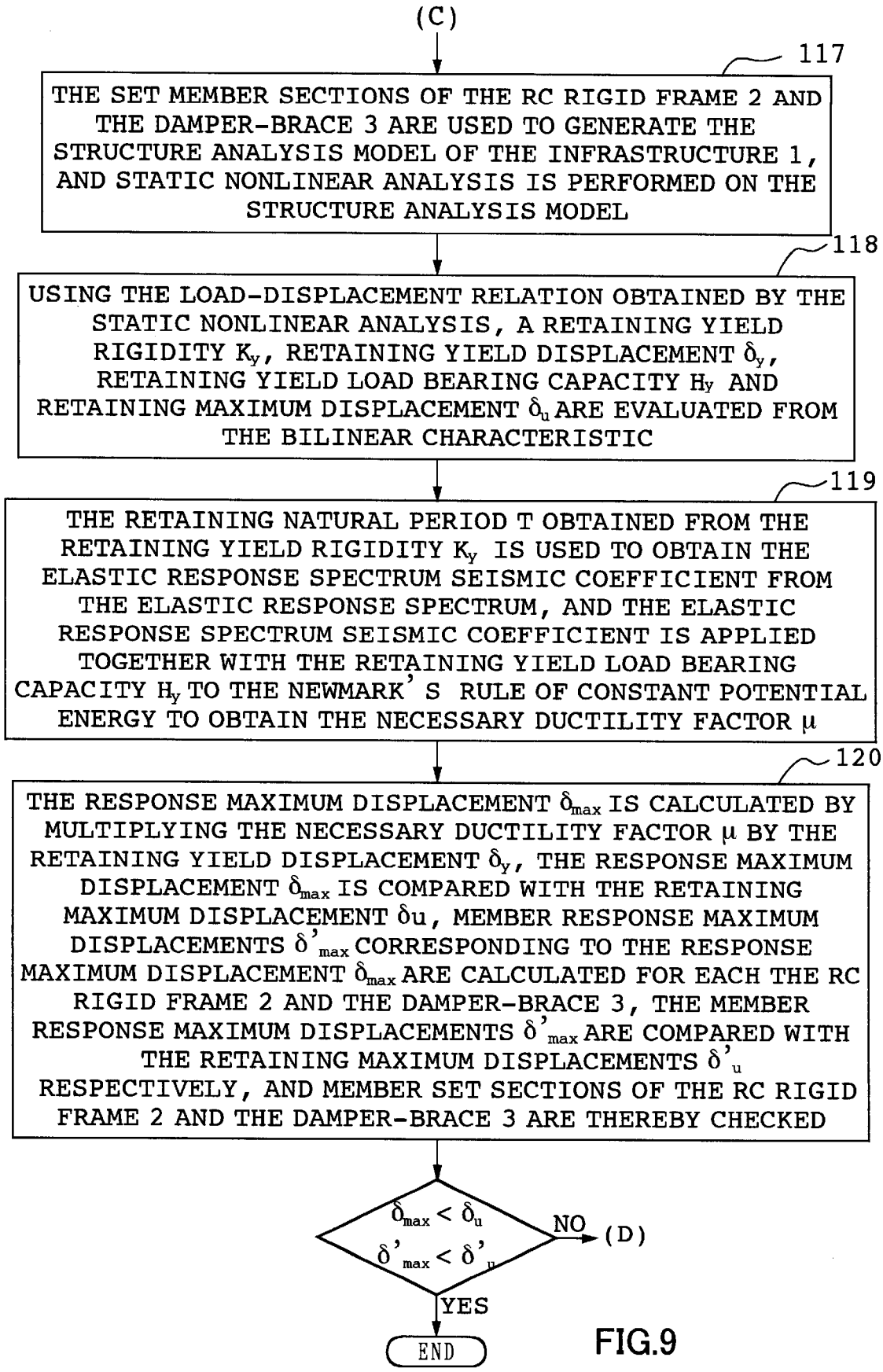
FIG. 9 is similarly a flowchart showing the design method of the elevated bridge infrastructure in the second embodiment.

FIGS. 8 and 9 are flowcharts showing the flow of the design method of the elevated bridge infrastructure according to the second embodiment.

To design the elevated bridge infrastructure 1 according to the design method of the elevated bridge infrastructure of the second embodiment, as seen from the flowcharts of FIGS. 8 and 9, first, the target ductility factor $\mu_d$ and target natural period $T_d$ for the infrastructure 1 are set in association with the assumed earthquake motion in the procedure similar to that of the first embodiment (step 111).

Next, the elastic response spectrum seismic coefficient corresponding to the target natural period $T_d$ is obtained from the elastic response spectrum corresponding to the assumed earthquake motion, and the elastic response spectrum seismic coefficient and target ductility factor $\mu_d$ are applied to Newmark's rule of constant potential energy to calculate the design seismic coefficient $K_h$ (step 112).

Specifically, $$K_h = \frac{\text{elastic response spectrum seimic coefficient}}{\sqrt{2\mu_d - 1}}$$

Figure 10:
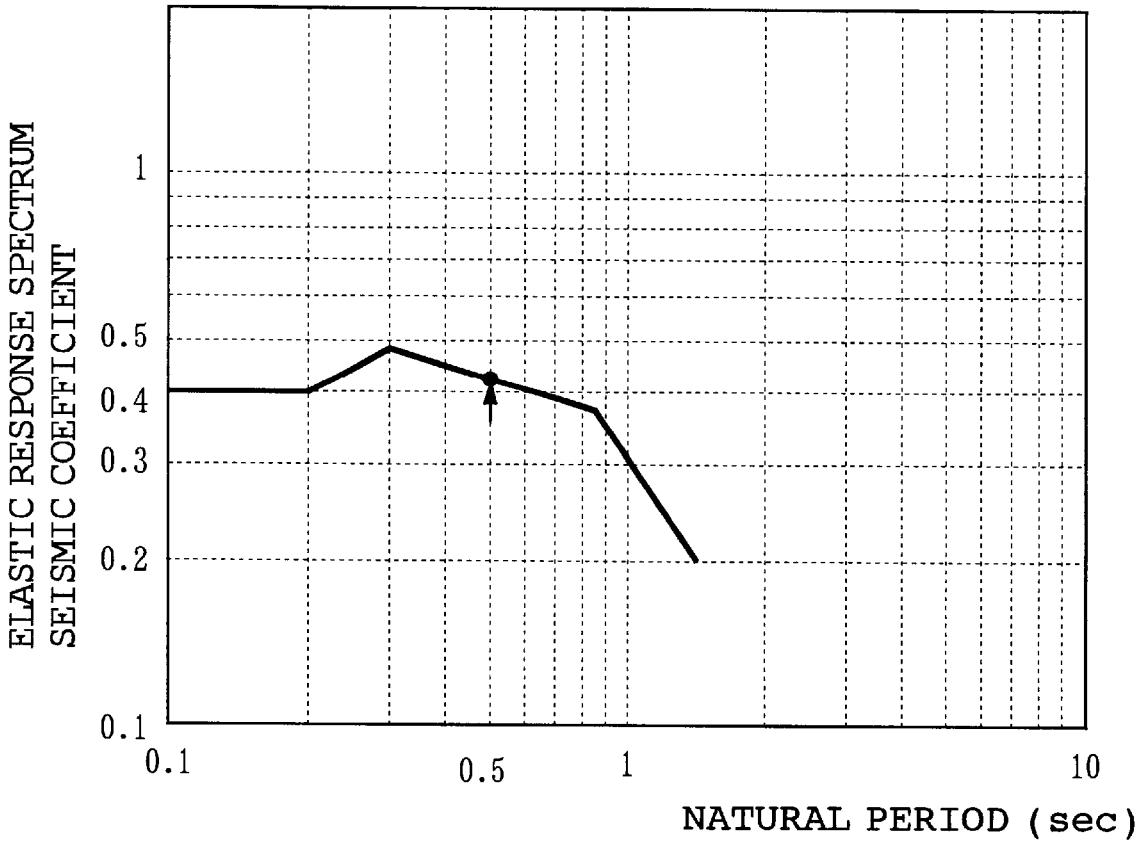
FIG. 10 is a graph showing an elastic response spectrum.

FIG. 10 shows the elastic response spectrum.

For the elastic response spectrum, since the maximum action horizontal force when the assumed earthquake motion is inputted to an elastic vibration system having an arbitrary rigidity is calculated, and the calculation result is divided by the weight in a dimensionless manner and plotted as the elastic response spectrum seismic coefficient, by associating the target natural period $T_d$ with the natural period of the abscissa, a value on the ordinate can be read as the elastic response spectrum seismic coefficient. Specifically, referring to FIG. 10, for example, since the target natural period $T_d$ indicates 0.5 second in a place shown by a circle mark of FIG. 10, the elastic response spectrum seismic coefficient indicates about 0.44.

On the other hand, the target yield rigidity $K_d$ corresponding to the target natural period $T_d$ is obtained (step 113). The target yield rigidity $K_d$ can be calculated from $K_d=(2\pi/T)^2W/g$ (g; gravitational acceleration) using the effective weight W of the infrastructure 1.

Thereafter, in the procedure similar to the procedure using the yield seismic coefficient spectrum (steps 104 to 106), the respective member sections of the RC rigid frame 2 and the damper-brace 3 are set (steps 114 to 116).

Subsequently, the set member sections of the RC rigid frame 2 and the damper-brace 3 are used to generate the structure analysis model of the infrastructure 1, and the static nonlinear analysis is performed on the structure analysis model (step 117).

Subsequently, the load-displacement relationship obtained by the static nonlinear analysis is replaced with the bilinear characteristic (see FIG. 6), and a retaining yield rigidity $K_y$, retaining yield displacement $\delta_y$, retaining yield load bearing capacity $H_y$ and retaining maximum displacement $\delta_u$ are evaluated from the bilinear characteristic (step 118).

Subsequently, the retaining natural period T obtained from the retaining yield rigidity $K_y$ is used to obtain the elastic response spectrum seismic coefficient from the elastic response spectrum, and the elastic response spectrum seismic coefficient is applied together with the retaining yield load bearing capacity $H_y$ to Newmark's rule of constant potential energy to obtain the necessary ductility factor $\mu$ (step 119).

Specifically, $$\mu = \frac{\left(\frac{\text{elastic response spectrum seismic coefficient}}{\text{retaining yield load bearing capacity } H_y}\right)^2 + 1}{2}$$

Subsequently, the response maximum displacement $\delta_{max}$ is calculated by multiplying the necessary ductility factor $\mu$ by the retaining yield displacement $\delta_y$, the response maximum displacement $\delta_{max}$ is compared with the retaining maximum displacement $\delta_u$, member response maximum displacements $\delta'_{max}$ corresponding to the response maximum displacement $\delta_{max}$ are calculated for each of the RC rigid frame 2 and the damper-brace 3, the member response maximum displacements $\delta'_{max}$ are compared with member retaining maximum displacements $\delta'_u$, respectively, and the set sections of the RC rigid frame 2 and the damper-brace 3 are thereby checked (step 120). Subsequently, when the condition $\delta_{max}<\delta_u$, $\delta'_{max}<\delta'_u$ is satisfied, the design is ended, and when the condition is not satisfied, the design returns to the step 116 to perform the section calculation again, and then the steps 116 to 120 are repeatedly performed until the above-described condition is satisfied.

Since the effect of the second embodiment is substantially similar to that of the first embodiment, the description thereof is omitted.

A third embodiment will next be described. Additionally, substantially the same components as those of the first and second embodiments are denoted with the same reference numerals and the description thereof is omitted.

Figure 11:
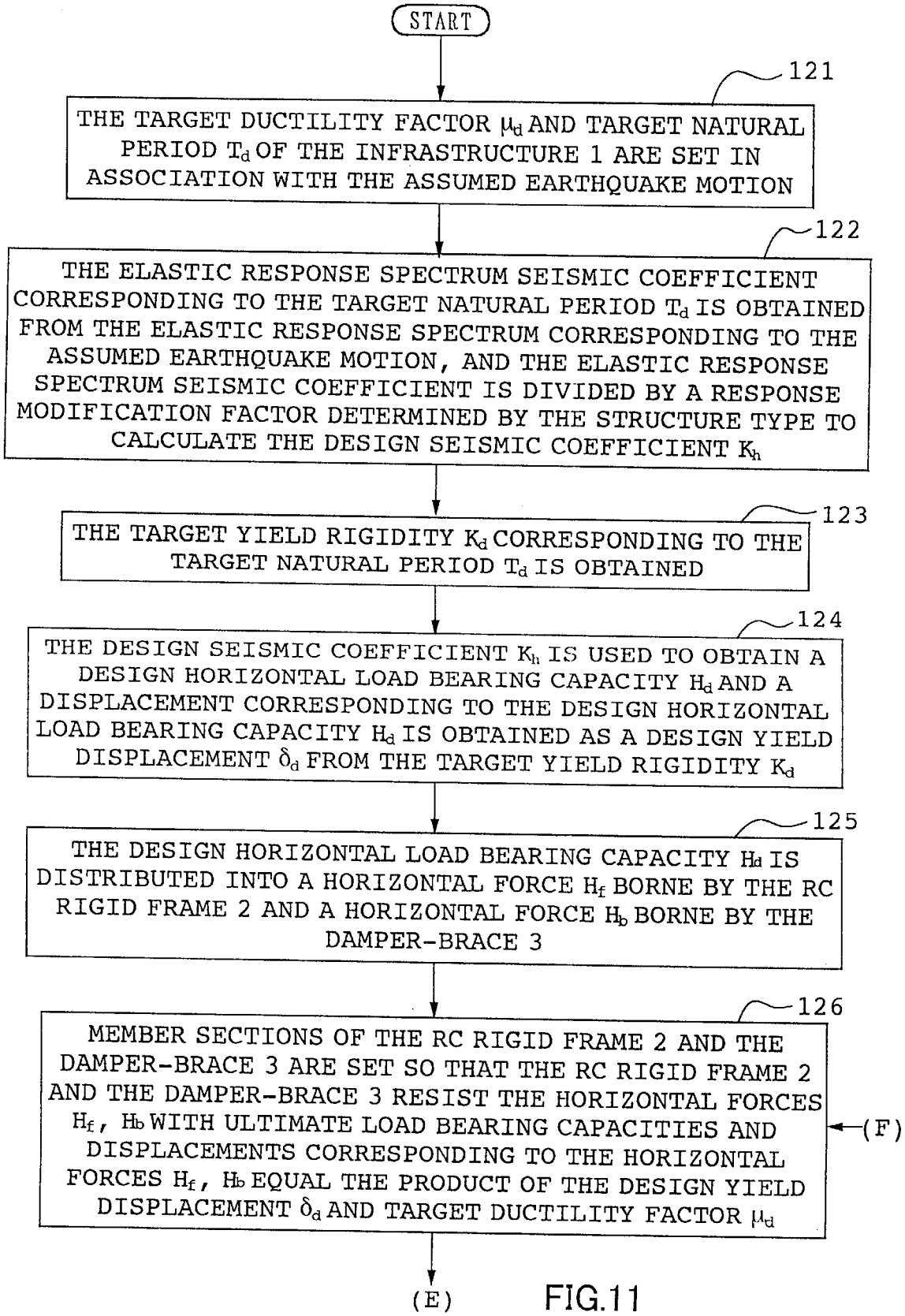
FIG. 11 is a flowchart showing the design method of an elevated bridge infrastructure in a third embodiment according to the present invention.
Figure 12:
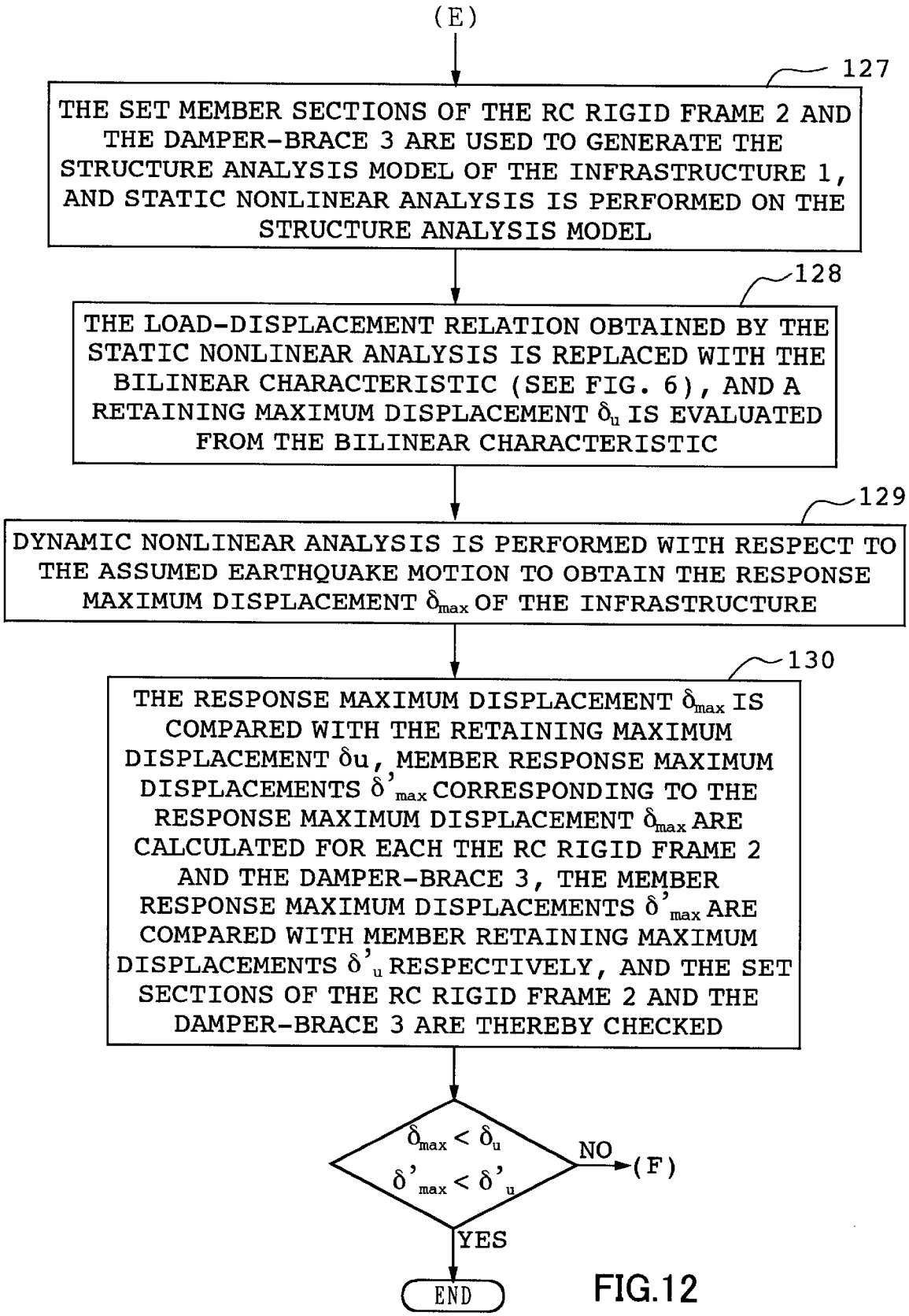
FIG. 12 is similarly a flowchart showing the design method of the elevated bridge infrastructure in the third embodiment.

FIGS. 11 and 12 are flowcharts showing the flow of the design method of the elevated bridge infrastructure according to the third embodiment.

To design the elevated bridge infrastructure 1 according to the design method of the elevated bridge infrastructure of the third embodiment, as seen from the flowcharts of FIGS. 11 and 12, first, the target ductility factor $\mu_d$ and target natural period $T_d$ for the infrastructure 1 are set in association with the assumed earthquake motion in the procedure similar to that of the first embodiment (step 121).

Next, the elastic response spectrum seismic coefficient corresponding to the target natural period $T_d$ is obtained from the elastic response spectrum corresponding to the assumed earthquake motion, and the elastic response spectrum seismic coefficient is divided by a response modification factor determined by the structure type to calculate the design seismic coefficient $K_h$ (step 122).

The response modification factor can be set to 2 when the elevated bridge infrastructure is, for example, a wall type bridge pier, set to 3 for a one-pillar bridge pier, and set to 5 for a multi-pillar bridge pier.

On the other hand, the target yield rigidity $K_d$ corresponding to the target natural period $T_d$ is obtained (step 123). The target yield rigidity $K_d$ can be calculated from $K_d=(2\pi/T)^2W/g$ (g; gravitational acceleration) using the effective weight W of the infrastructure 1.

Thereafter, in the procedure similar to the procedure using the yield seismic coefficient spectrum (steps 104 to 106), the respective member sections of the RC rigid frame 2 and the damper-brace 3 are set (steps 124 to 126).

Subsequently, the set member sections of the RC rigid frame 2 and the damper-brace 3 are used to generate the structure analysis model of the infrastructure 1, and the static nonlinear analysis is performed on the structure analysis model (step 127).

Subsequently, the load-displacement relationship obtained by the static nonlinear analysis is replaced with the bilinear characteristic (see FIG. 6), and a retaining maximum displacement $\delta_u$ is evaluated from the bilinear characteristic (step 128).

Subsequently, dynamic nonlinear analysis is performed with respect to the assumed earthquake motion to obtain the response maximum displacement $\delta_{max}$ of the infrastructure (step 129). For the dynamic nonlinear analysis, for example, the structure analysis model subjected to the static nonlinear analysis can be used as it is.

Subsequently, the response maximum displacement $\delta_{max}$ is compared with the retaining maximum displacement $\delta_u$, member response maximum displacements $\delta'_{max}$ corresponding to the response maximum displacement $\delta_{max}$ are calculated for each of the RC rigid frame 2 and the damper-brace 3, the member response maximum displacements $\delta'_{max}$ are compared with member retaining maximum displacements $\delta'_u$, respectively, and the set sections of the RC rigid frame 2 and the damper-brace 3 are thereby checked (step 130). Subsequently, when the condition $\delta_{max}<\delta_u$, $\delta'_{max}<\delta'_u$ is satisfied, the design is ended, and when the condition is not satisfied, the design returns to the step 126 to perform the section calculation again, and then the steps 126 to 130 are repeatedly performed until the above-described condition is satisfied.

Since the effect of the third embodiment is substantially similar to that of the first embodiment, the description thereof is omitted.

The RC frame seismic reinforcement process according to the present invention includes the steps of partially cutting an RC member main reinforcement bar in an RC member, and shifting the failure property of the RC member from a shear failure preceding type to a bending failure preceding type. FIG. 13 shows an elevated bridge infrastructure 41 to which such a seismic reinforcement process is applied.

Figure 13A:
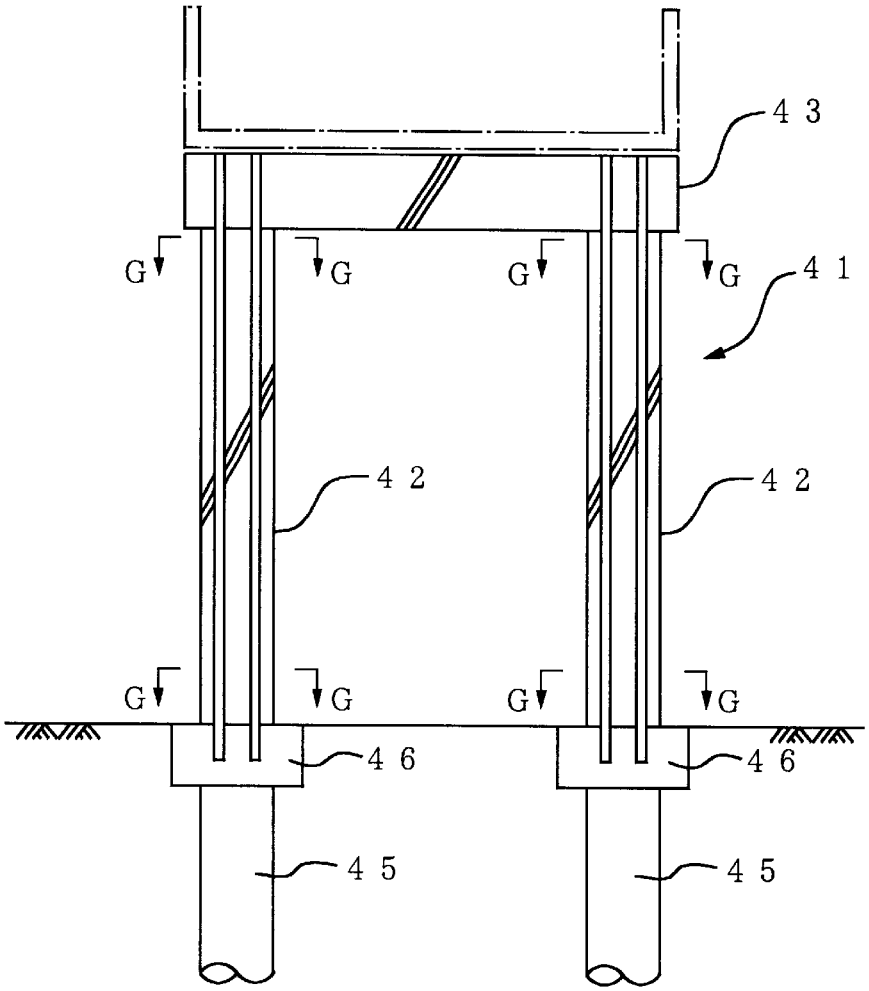
FIG. 13A is a front view showing an elevated bridge infrastructure to which a seismic reinforcement process of an RC frame according to the present invention is applied.
Figure 13B:
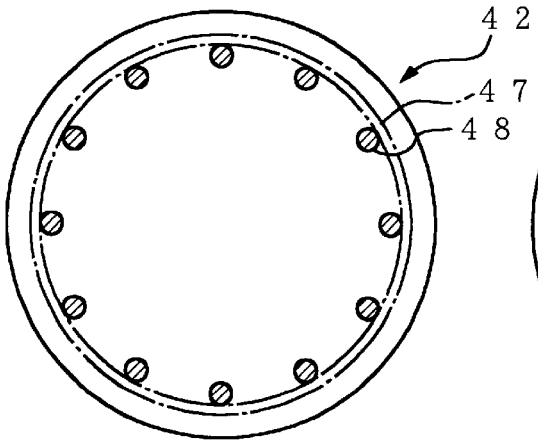
FIG. 13B is a horizontal sectional view taken along line G—G before the reinforcement.

The elevated bridge infrastructure 41 as an RC frame shown in FIG. 13 is provided with RC pillar members 42, 42 as RC members and an RC beam member 43 extended between the head parts of the RC pillar members. The RC pillar members 42, 42 are so-called shear failure preceding type RC members in which, since the steel reinforcement amount of a hoop reinforcement bar 47 (see FIG. 13B) as the shear reinforcement bar is relatively smaller than the steel reinforcement amount of a main reinforcement bar 48, the shear strength is low, the shear failure occurs before the bending failure occurs, and thus brittleness failure occurs. Additionally, the RC pillar member 42 is vertically disposed on a footing 46 disposed on the head part of a pile 45.

Figure 13C:
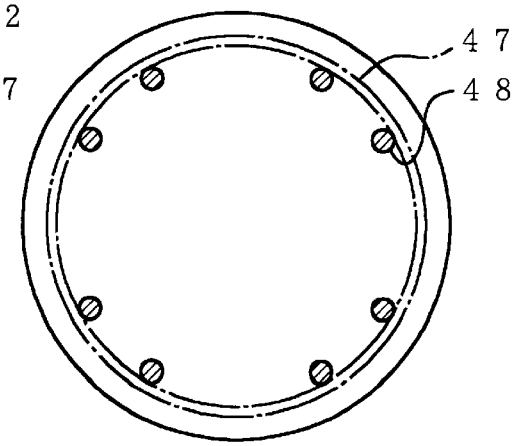
FIG. 13C is similarly a horizontal sectional view along the line G—G after the reinforcement.

In the seismic reinforcement process of the RC frame, a part of the main reinforcement bar 48 of the shear failure preceding type RC pillar members 42, 42 is cut in the pillar leg and head parts as shown in FIG. 13C. For example, among twelve main reinforcement bars 48 before the seismic reinforcement is performed as shown in the example of FIG. 13, four reinforcement bars positioned in the directions of 0°, 90°, 180°, 270° are cut, and the main reinforcement bars are reduced to provide eight reinforcement bars in total.

For cutting, the height at which no hoop reinforcement 47 runs is selected, and the main reinforcement bar is cut together with the covering concrete by a diamond cutter or the like, and after cutting, the place in which the concrete is cut is filled with cement milk or the like as occasion demands, so that the rust prevention of the main reinforcement bar 48 or the like is preferably performed.

Figure 14:
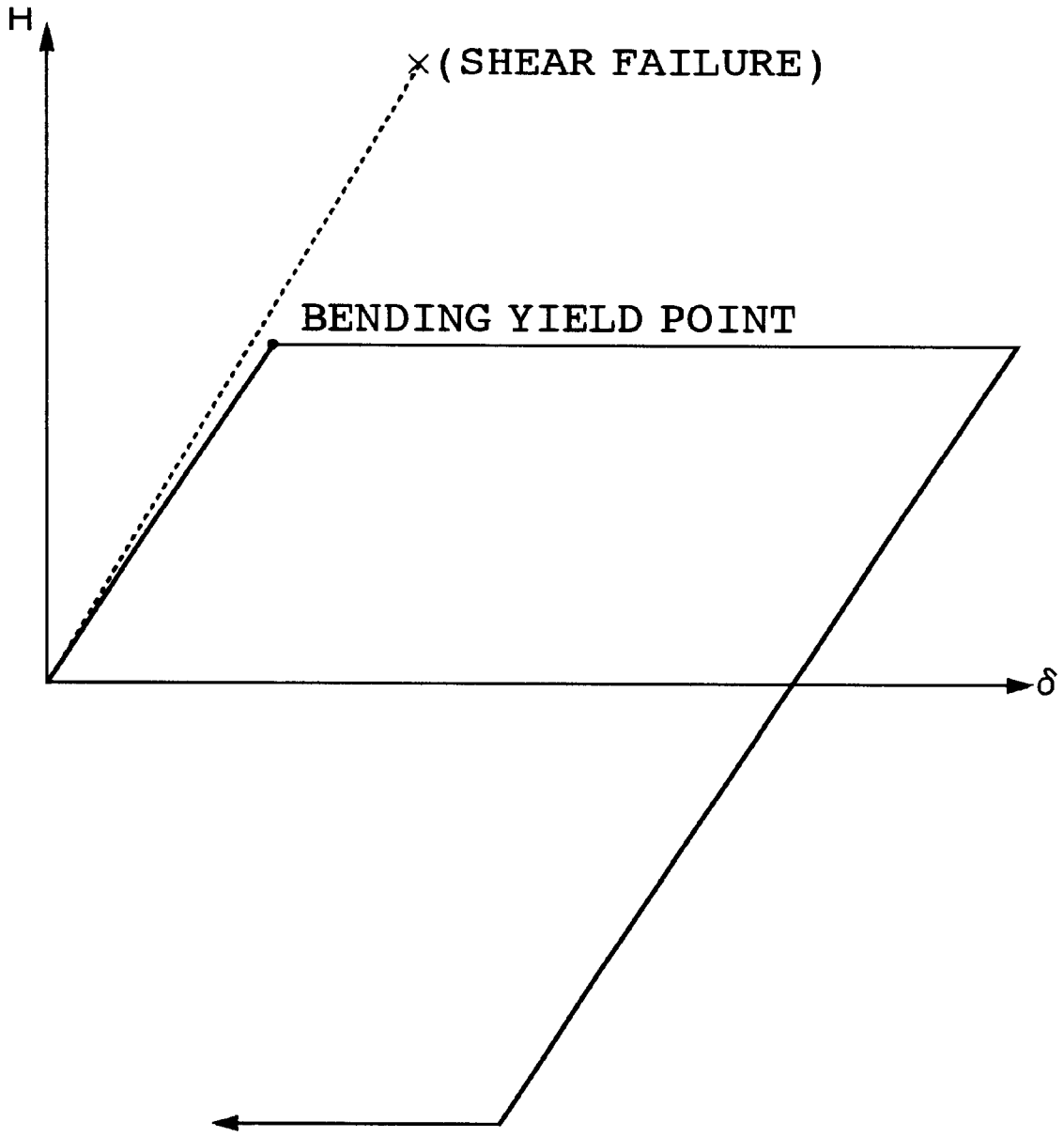
FIG. 14 is a schematic view showing an effect of the seismic reinforcement process of the RC frame according to the present invention.

When parts of the main reinforcement bar 48 are cut, the bending yield point of each RC pillar member 42 lowers, the shear yield point relatively rises accordingly, and the failure property of the RC pillar member shifts from the shear failure preceding type to the bending failure preceding type. Moreover, for each RC pillar member 42, different from the shear failure which exhibits the brittleness failure, the failure property exhibits much ductility, and by repeating the bending deformation along the hysteresis curve shown in FIG. 14, energy is absorbed in the form of hysteresis attenuation during an earthquake, before failure moderately occurs.

As described above, according to the seismic reinforcement process of the RC frame of the present embodiment, by cutting a part of the main reinforcement bar 48, the failure property of the RC pillar member 42 can shift from the shear failure preceding type to the bending failure preceding type.

Therefore, the RC pillar member 42 fulfills the hysteresis attenuation by the bending deformation during the earthquake, and absorbs the vibration energy of the entire RC rigid frame, so that the seismic properties of the RC pillar member 42 and the entire RC rigid frame is enhanced. Moreover, since it is sufficient only to cut the main reinforcement bar 48, the seismic reinforcement can be finished in a short time.

Additionally, when the main reinforcement bar 48 is cut, the bending yield point of the RC pillar member 42 accordingly lowers, and the RC pillar member 42 accordingly enters the region with a smaller earthquake load, but the hysteresis attenuation is fulfilled by repeating the bending deformation along the hysteresis curve as described above even if the bending yield point is exceeded. As a result, the seismic properties of the RC pillar member 42 and the entire RC rigid frame can be enhanced.

In the present embodiment, the seismic reinforcement process of the RC frame of the present invention is applied in the plane crossing at right angles to the bridge axis in the elevated bridge infrastructure, but needless to say, the present invention can be applied in the plane parallel to the bridge axis. Moreover, the plane to which the damper-brace mechanism is to be attached is arbitrary, and the mechanism may be attached in all the planes of the RC frame, or only in some planes.

Moreover, in the present embodiment, the seismic reinforcement process of the RC frame of the present invention is applied to the elevated bridge infrastructure 41, but the applicable object is not limited to such structure, and the present invention can also be applied to other constructed structures and further to seismic walls in the architectural field.

Figure 15:
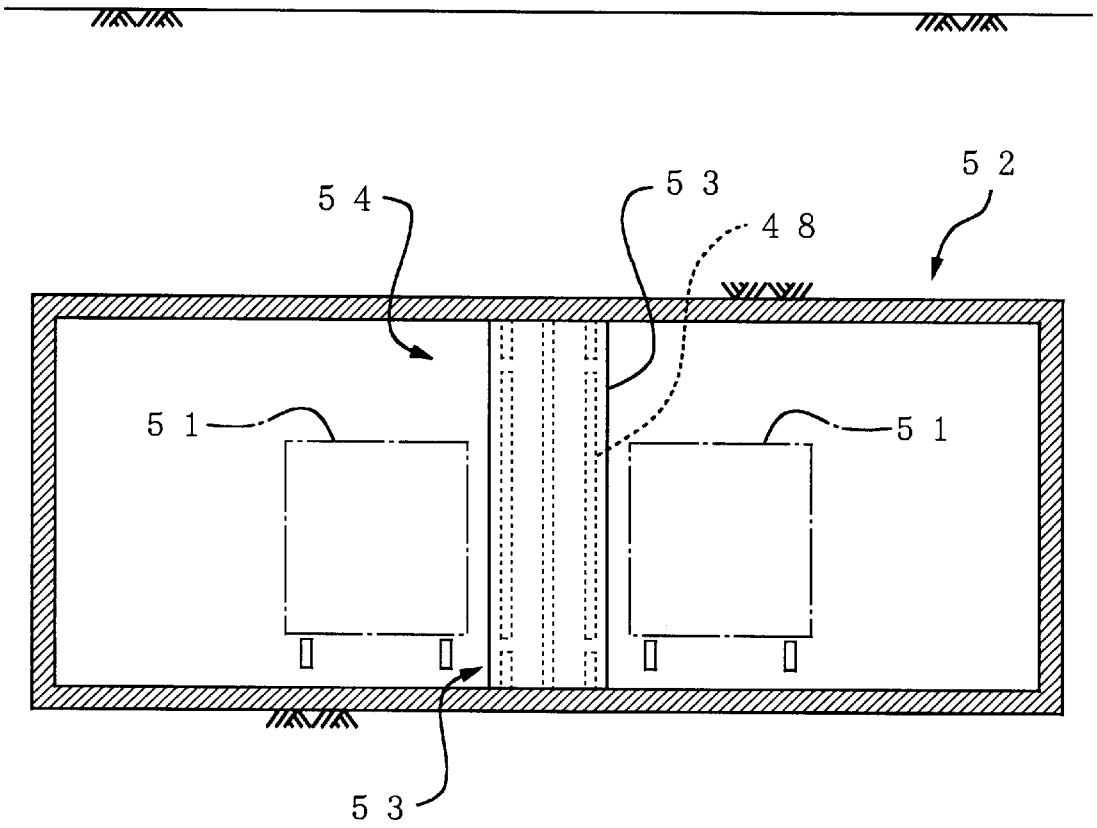
FIG. 15 is a sectional view showing another structure to which the seismic reinforcement process of the RC frame of the present invention is applied.

FIG. 15 shows that the seismic reinforcement is performed on a middle pillar 53 of an underground structure 52 in which a subway 51 runs, and a part of the main reinforcement bar 48 of the pillar is cut in a pillar leg part 53 and pillar head part 54.

Since the middle pillar 53 of the underground structure 52 has many main reinforcement bars and less shear reinforcement bars, shear failure tends to precede bending failure, but according to the seismic reinforcement process of the present invention, similarly to the above-described embodiments, it is possible to shift the type of failure to the bending failure preceding type and enhance the seismic property.

Moreover, in the present embodiment, four main reinforcement bars 48 in total are cut every 90° and cutting is performed in both the pillar leg part and pillar head part, but the number of reinforcement bars to be cut and angular positions are arbitrary, and needless to say, the main reinforcement bars may be cut in either the pillar leg part or the pillar head part as occasion demands.

The seismic reinforcement process of the RC frame of another preferred embodiment according to the present invention comprises the steps of: cutting a part of the main reinforcement of the RC pillar member constituting the RC rigid frame to shift the failure property of the RC member from the shear failure preceding type to the bending failure preceding type; and attaching the damper-brace mechanism in the plane of the RC rigid frame. Such seismic reinforcement process is applied to the elevated infrastructure 41 shown in FIG. 16.

Figure 16:
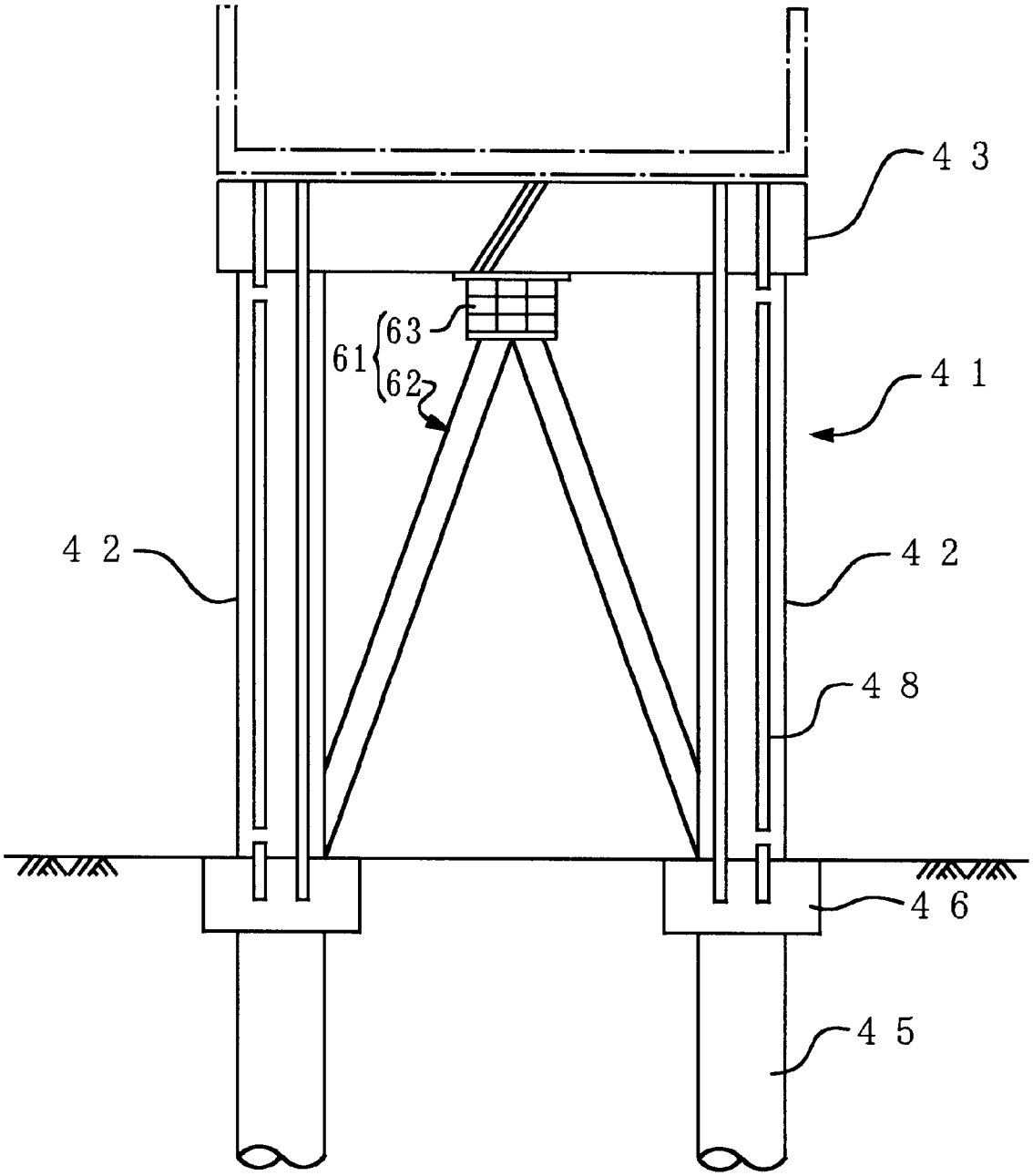
FIG. 16 is a front view showing an elevated bridge infrastructure to which a seismic reinforcement process of an RC frame according to the present invention is applied.

In the seismic reinforcement process of the RC frame of the present embodiment, the main reinforcement bars 48 of the RC pillar members 42, 42 of the shear failure preceding type are cut in a similar manner as shown FIGS. 13A–13C, and a damper-brace mechanism 61 is attached in the plane of the RC rigid frame constituted of the RC pillar members 42, 42 and RC beam member 43 extended between the head parts as shown in FIG. 16.

The damper-brace mechanism 61 is provided with an inverse V-shaped brace 62 and a damper 63 attached between the top of the brace and the RC beam member 43. The damper causes an elasto-plastic deformation when the relative displacement between the beam member 43 and the brace 62 is forcibly added, and absorbs the energy of the RC rigid frame during the earthquake by the hysteresis attenuation to decrease the vibration. The damper 63 can be constituted, for example, of a low yield point steel or ordinary steel plate provided with a slit.

When parts of the main reinforcement bars 48 of the shear failure preceding type RC pillar members 42, 42 as the constituting elements of the RC rigid frame are cut with the diamond cutter or the like, the bending yield point of each RC pillar member 42 lowers, the shear yield point accordingly rises relatively, and the failure property of the RC pillar member shifts from the shear failure preceding type to the bending failure preceding type. Moreover, for each RC pillar member 42, different from the shear failure which exhibits the brittle failure, by repeating the bending deformation along the hysteresis curve, the energy is absorbed in the form of hysteresis attenuation during the earthquake, and the failure moderately occurs.

Moreover, since not only the RC rigid frame but also the damper-brace mechanism 61 bear the horizontal force during the earthquake, the member force generated in the RC pillar members 42, 42 is accordingly reduced. Even at the earthquake level at which the RC pillar members 42, 42 enter the elasto-plastic region without the damper-brace mechanism 61, in the present embodiment, the RC pillar member 42 elastically behaves without exceeding the bending yield point.

Figure 17A:
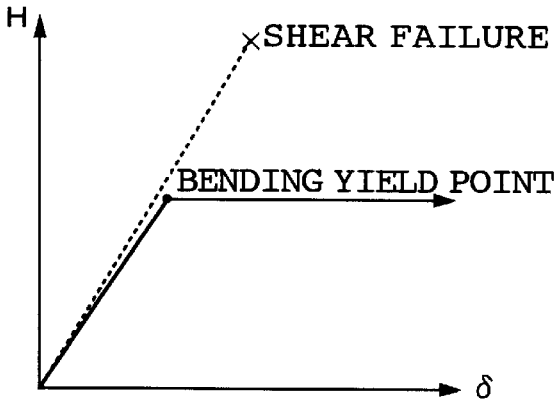
Figure 17B:
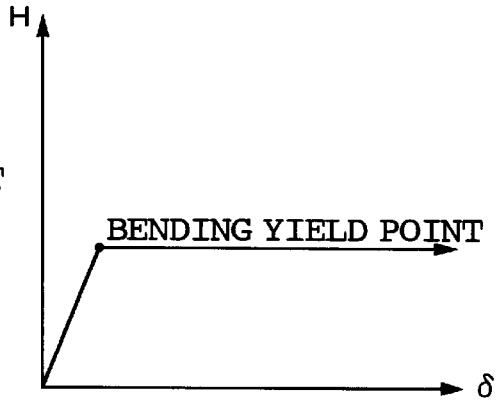
Figure 17C:
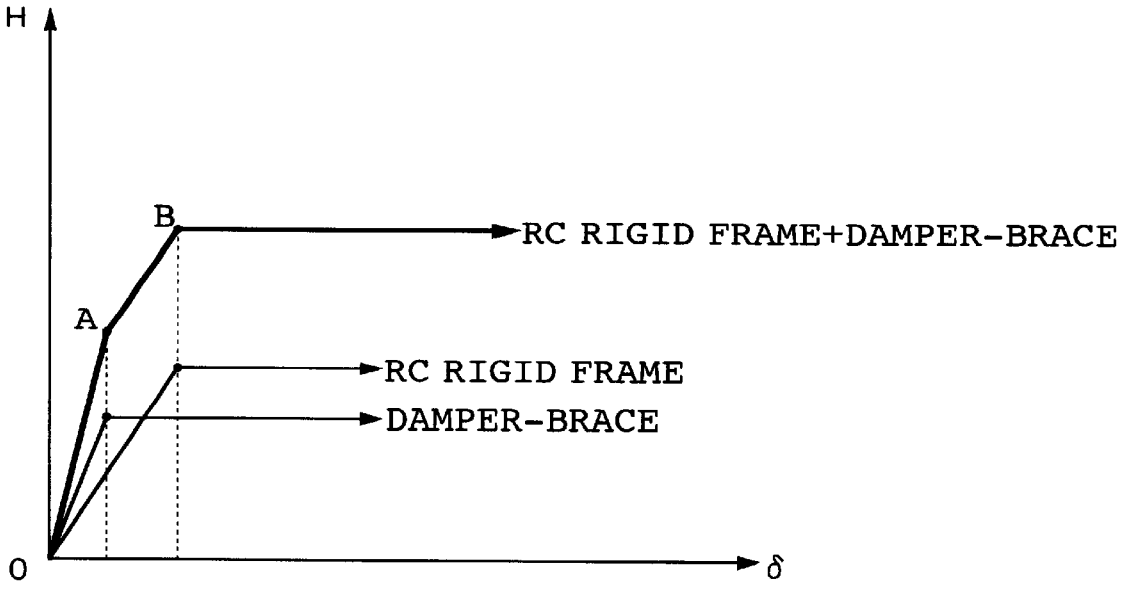

FIGS. 17A–17C show the change of the restoring force characteristic of the elevated bridge infrastructure 41 by the use of the seismic reinforcement process of the present embodiment. FIG. 17A shows the restoring force characteristic of the RC rigid frame when no reinforcement is performed by a broken line and the restoring force characteristic when the reinforcement is performed by a solid line, and FIG. 17B shows the restoring force characteristic of the damper-brace mechanism 61. Moreover, FIG. 17C shows the entire overlapped restoring force characteristics. Additionally, FIG. 17C also shows the restoring force characteristics of the RC rigid frame alone and damper-brace mechanism alone by way of precaution.

As seen from FIG. 17C, after the seismic reinforcement is performed, the restoring force characteristic passes from an origin 0 via a first point A to a second point B, and thereafter only the deformation advances.

The situation during the earthquake will concretely be described by referring to the restoring force characteristic. First, in a small earthquake, the RC rigid frame including the RC pillar members 42, 42 and damper-brace mechanism 61 is deformed in accordance with the borne horizontal forces during the earthquake, but the deformation is restricted within the elastic range (origin 0 to first point A), and no damage is caused in the RC rigid frame or the damper-brace mechanism 61.

Subsequently, in a medium-degree earthquake, the damper 63 of the damper-brace mechanism 61 is deformed beyond the yield point (first point A to second point B), but in such situation, the damper 63 fulfills the hysteresis attenuation and the vibration by the earthquake therefore converges quickly. Moreover, since the RC rigid frame behaves in the elastic range, no damage is generated in the RC pillar member 42, and the soundness of the entire structure is completely maintained. Additionally, when the damper 63 is largely damaged, needless to say, the damper can be changed with a new one at any time.

Moreover, in a big earthquake, the RC pillar member 42 and the damper 63 of the damper-brace mechanism 61 are largely deformed beyond the respective yield points (on and after the second point B), but the RC pillar member 42 and damper 63 fulfill a large hysteresis attenuation to absorb the earthquake energy, and the RC pillar member 42 continuously supports a perpendicular load even during the final stage in which the damper 63 is ruptured, without causing the brittleness failure, so that the collapse of the entire structure can be avoided beforehand.

As described above, according to the seismic reinforcement process of the RC frame of the present embodiment, the failure property of the RC pillar member 42 can be shifted from the shear failure preceding type to the bending failure preceding type by cutting a part of the main reinforcement bar 48.

Therefore, the RC pillar member 42 fulfills the hysteresis attenuation by the bending deformation during the earthquake to absorb the vibration energy of the entire RC rigid frame, and the seismic properties of the RC pillar member 42 and the entire RC rigid frame are enhanced. Moreover, since it is sufficient only to cut the main reinforcement bar 48, it is possible to finish the seismic reinforcement in a remarkably short time.

Moreover, according to the seismic reinforcement process of the RC frame of the present embodiment, by attaching the damper-brace mechanism 61 in the plane of the RC rigid frame, a decrease of the burden horizontal force of the RC rigid frame because of the drop of the bending yield point of the RC pillar member 42 can be loaded onto the damper-brace mechanism 61 such that in a medium/small earthquake the damage and deformation of the entire structure are minimized, and in a big earthquake the energy during the earthquake is absorbed by the hysteresis attenuation by the deformation of the RC pillar member 42 and damper 63, and the collapse of the entire structure can be prevented.

Particularly, according to the present embodiment, as seen from the restoring force characteristic of FIGS. 17A–17C, since the damper 63 of the damper-brace mechanism 61 is allowed to yield prior to the RC pillar member 42, no damage is generated in the RC rigid frame including the RC pillar member 42 at least during a medium earthquake level or less (range to the second folded point B), and the damaged damper 63 may appropriately be changed, so that the soundness of the structure can completely be maintained at such an earthquake level.

As not particularly referred to in the present embodiment, if the increase of the burden horizontal force by the damper-brace mechanism 61 is allowed to become equal to the decrease of the burden horizontal force of the RC rigid frame with the cutting of the main reinforcement bars 48, the horizontal load bearing capacity of the entire structure is unchanged. Specifically, the size of the horizontal force acting on the footing 46 of the RC pillar member 42 during the earthquake is unchanged before and after the reinforcement, and the reinforcement around the foundation is unnecessary with the above-described seismic reinforcement.

Moreover, in the present embodiment, the seismic reinforcement process of the RC frame of the present invention is applied to the elevated bridge infrastructure 41, but the applicable object is not limited to such structure, and the present invention can also be applied to not only other constructed structures but also to seismic walls of the architectural field.

Figure 18:
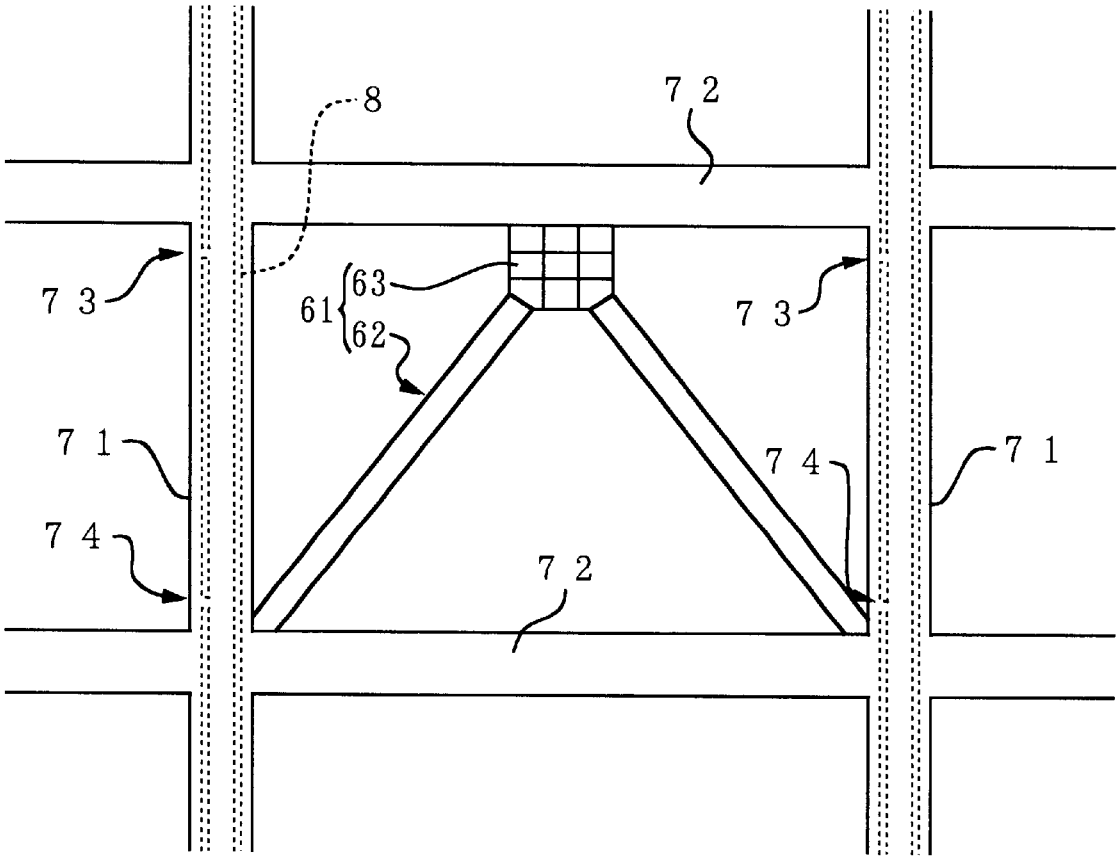
FIG. 18 is a front view showing an another structure to which the seismic reinforcement process of the RC frame of the present invention is applied.

FIG. 18 shows an example in which the seismic reinforcement is performed on the RC rigid frame provided with RC pillar members 71, 71 and RC beam members 72, 72, and part of the main reinforcement bars 48 of the pillar members 71 are cut in a pillar leg part 74 and pillar head part 73. Additionally, since the effect of this modified example is substantially similar to the effect of the above-described embodiment, the description thereof is omitted here.

Moreover, in the present embodiment, the damper 63 of the damper-brace mechanism 61 is allowed to yield prior to the RC pillar members 42, 42, but the proportion of the main reinforcement bars 48 to be cut, that is, the setting of the horizontal load bearing capacity of the RC rigid frame is arbitrary, and it is also arbitrary to design the damper-brace mechanism 61 so that the decrease is compensated for, or to design the damper-brace mechanism 61 regardless of the decrease.

Figure 19:
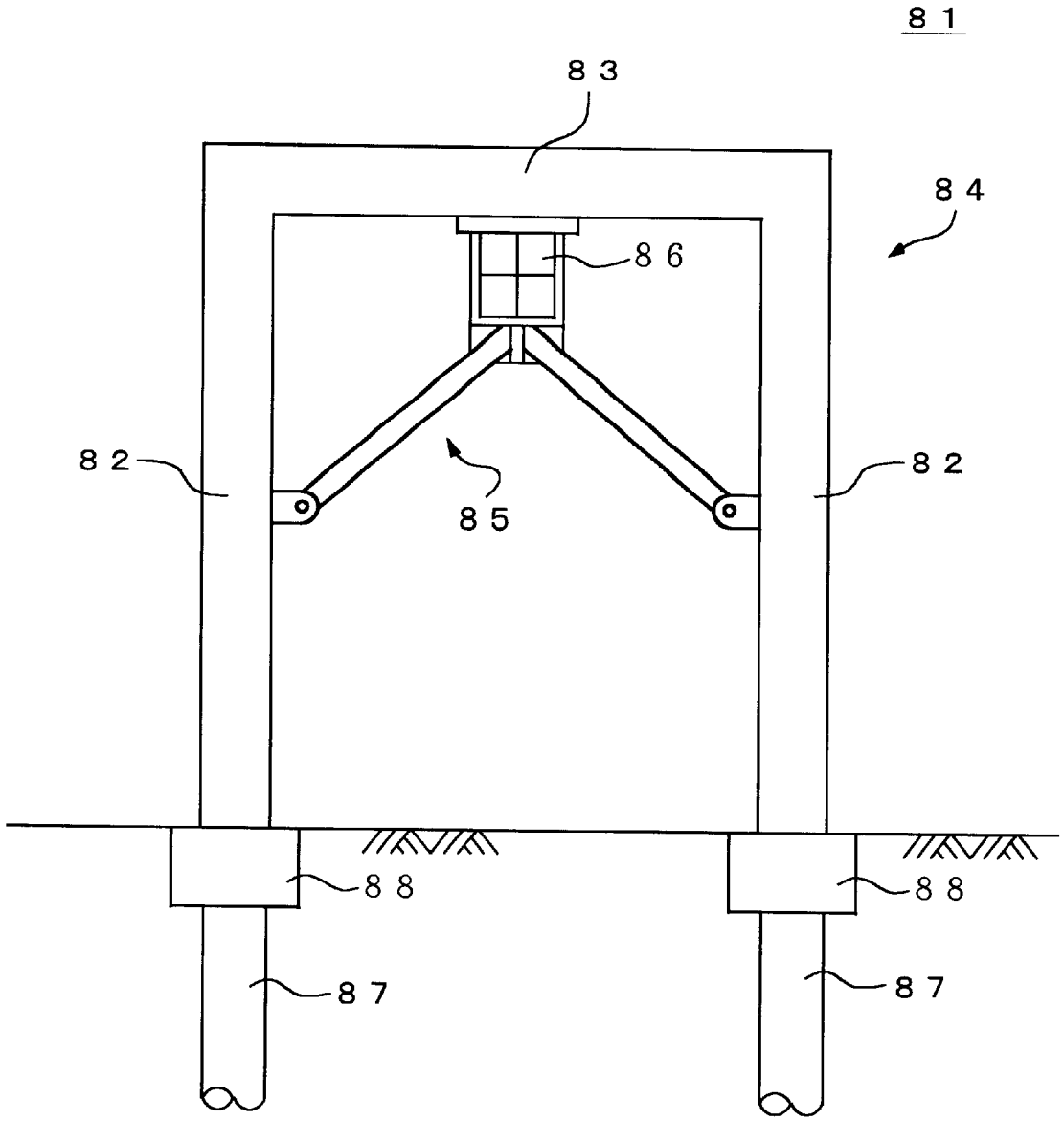
FIG. 19 is a front view of an elevated bridge infrastructure as a seismic frame structure according to the present invention as seen from the bridge axial direction.

FIG. 19 is a front view of the elevated bridge infrastructure as the seismic frame structure according to the present invention as seen from the bridge axial direction. As seen from FIG. 19, an elevated bridge infrastructure 81 of the present embodiment comprises: an RC rigid frame 84 constituted of a pair of pillars 82, 82 vertically disposed opposite to each other like a bridge pier and a beam 83 extended between tops of the pillars 82,82; an inverse V-shaped eccentric brace material 85 which is disposed in the structural plane of the RC rigid frame 84 and whose both ends are pinned to the vicinities of the middle positions of the pillars 82, 82; and a hysteresis shear damper 86 interposed between the upper end of the inverse V-shaped eccentric brace material 85 and the beam 83. Here, the pillar 82 is vertically disposed on a footing 88 disposed on a pile 87. Moreover, the eccentric brace material 85 can be formed, for example, of a steel frame material.

The hysteresis shear damper 86 absorbs the vibration energy during the earthquake by the hysteresis damping, and quickly decreases the vibration of the elevated bridge in the direction crossing at right angles to the bridge axis.

The hysteresis shear damper 86 may be constituted by forming a large number of slits in an ordinary thin steel plate, or may be formed of an excessively soft steel, and it is preferable to dispose a reinforcing rigid rib and prevent a local buckling as occasion demands. The hysteresis shear damper 86 may be detachably attached between the eccentric brace material 85 and the beam 83 so that the damper can be changed during maintenance.

Both ends of the inverse V-shaped eccentric brace material 85 are pinned, for example, in the vicinity of the bisector point of the pillar 82.

The elevated bridge infrastructure 81 is constituted so that plastic hinges are generated in the upper and lower ends of the pillar 82 during a big earthquake. In this case, a curvature of the pillar 82 is generated only in the upper and lower ends, and each pillar 82 is substantially linearly inclined in a middle position.

Figure 20:
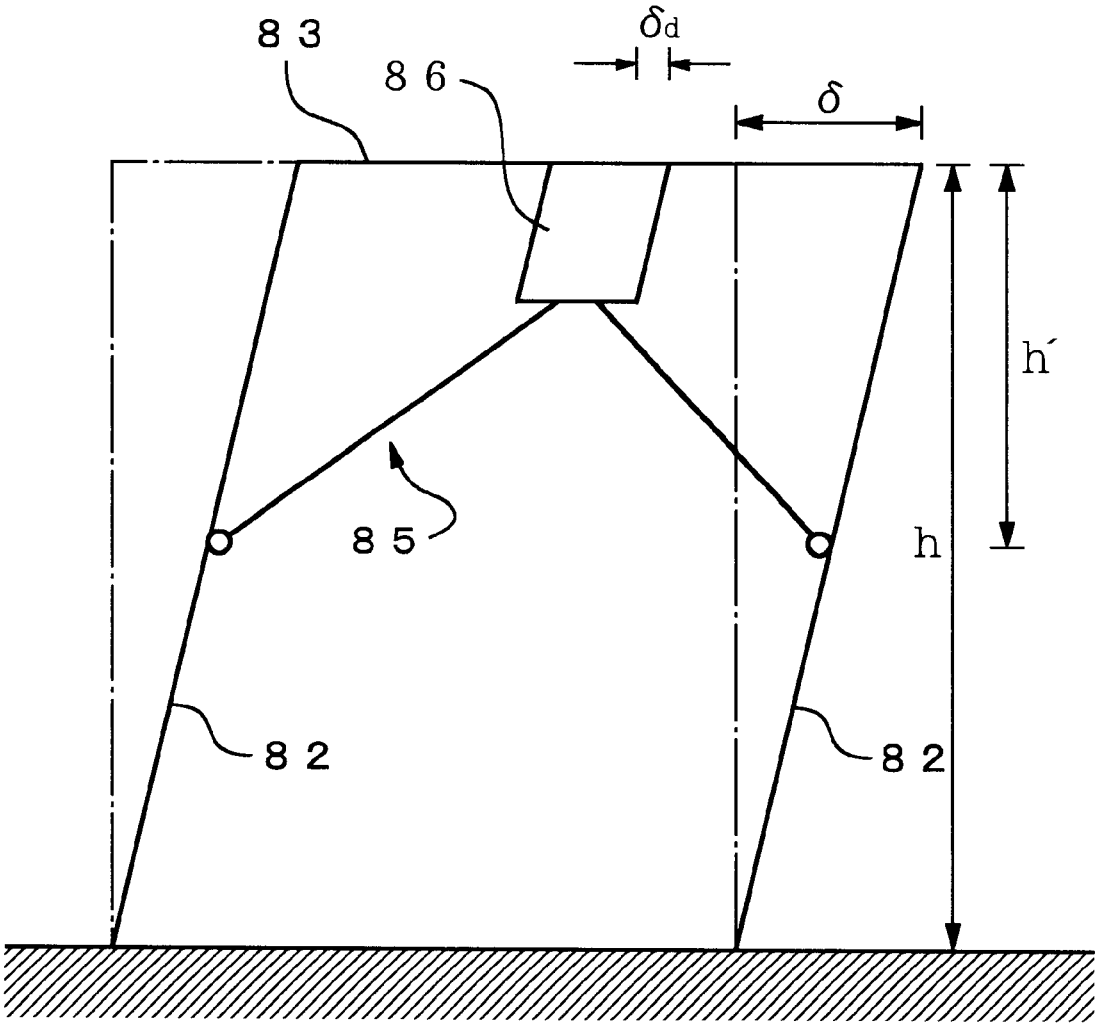
FIG. 20 is a schematic view showing an effect of the elevated bridge infrastructure.

Moreover, since the hysteresis shear damper 86 is subjected to forcible deformation from the linearly inclined pillar 82, as shown in FIG. 20, the relative horizontal deformation amount $\delta_d$ generated in the hysteresis shear damper 86 is reduced to be lower than the entire horizontal deformation amount 6 generated in the RC rigid frame 84 in accordance with the attachment height ratio of the end of the eccentric brace material 85, that is, (h'/h) (h; height to the beam 83 from the leg part of the pillar 82, h'; height to the beam 83 from the brace connection position on the pillar 82), and (h'/h) δ results.

Specifically, when the end of the eccentric brace material 85 is pinned right to the bisector point of the pillar 82, the relative horizontal deformation amount $\delta_d$ generated in the hysteresis shear damper 86 is substantially ½ of the horizontal deformation amount δ generated in the RC rigid frame 84.

Therefore, in this case, the RC rigid frame 84 can be deformed twice as much as the conventional amount, without failure of the hysteresis shear damper 86, and the ductility of the RC rigid frame 84 can sufficiently be utilized.

Additionally, since the eccentric brace material 85 is pinned to the pillar 82, no bending moment is possibly generated in the end of the eccentric brace material 85, so that there is no possibility that the end is subjected to the bending failure in the pin connection place.

Figure 21:
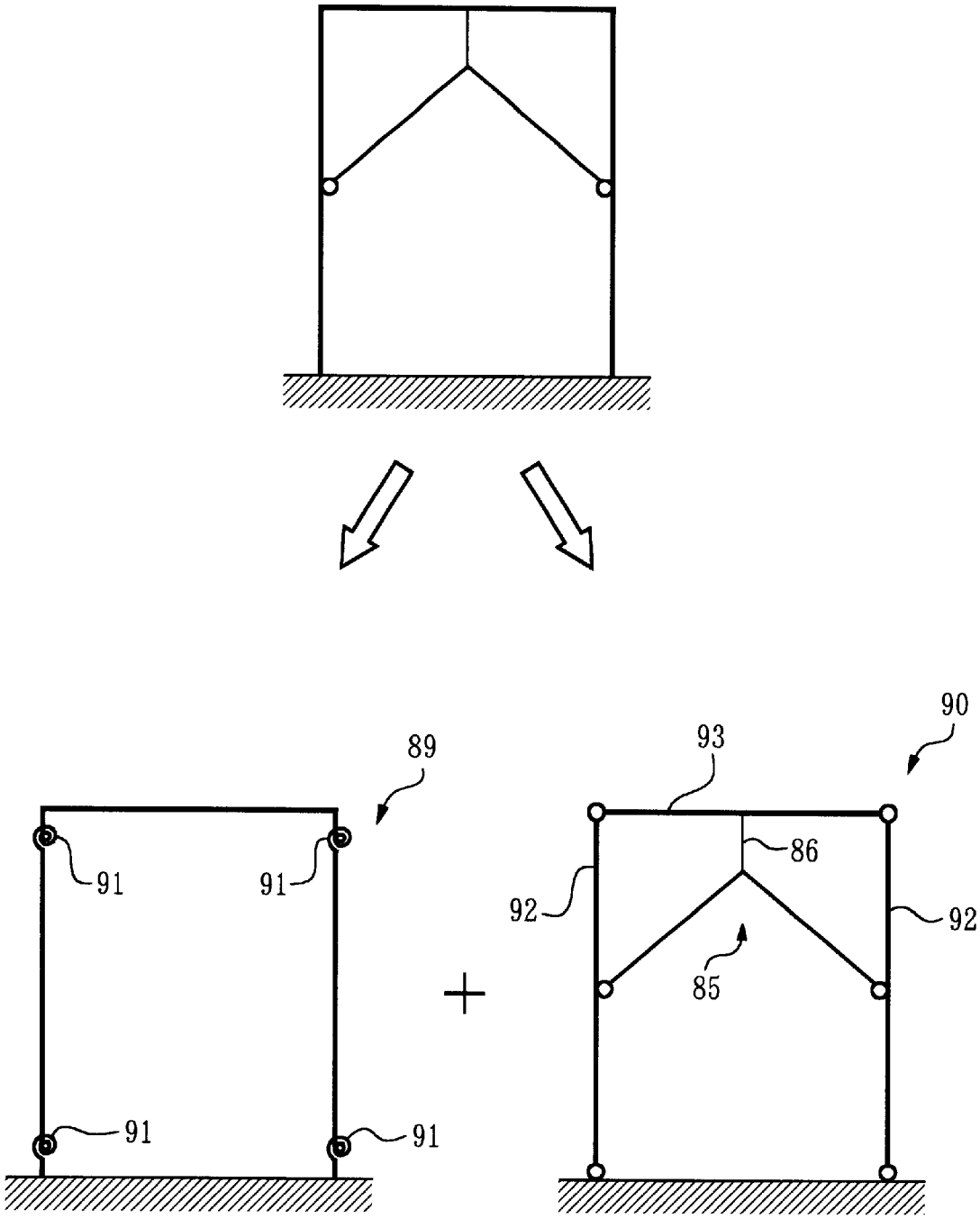
FIG. 21 is a schematic view showing a design method of a seismic frame structure according to the present invention.

Subsequently, in order to design the elevated bridge infrastructure 81 as the seismic frame structure of the present invention, first the elevated bridge infrastructure 81 is disassembled into two models, i.e. an RC analysis mode 89 and damper-brace analysis model 90 as shown in FIG. 21. This is developed by considering that the entire system mixed with the RC rigid frame 84 and damper-brace (eccentric brace material 85 and hysteresis shear damper 86) is not suitable for practical use, because the modeling is intricate and difficult and the analysis time is lenghtened.

Here, the RC analysis model 89 is formed on condition that the RC rigid frame 84 is plasticized in the upper and lower ends of the pillar 82 and the pillar head and pillar leg of the RC rigid frame are replaced with rotational springs 91 as shown in FIG. 21.

Additionally, the rotational spring 91 is a nonlinear spring with respect to the displacement (rotational amount), has a large rigidity corresponding to the rigid joint in a region with a small rotational amount, that is, in an elastic region, but is plasticized as the deformation advances, and has a small rigidity in a large deformation region.

On the other hand, in the damper-brace analysis model 90, the pillar 82 and beam 83 are replaced with a virtual rigid pillar 92 and virtual rigid beam 93, pin connected to each other, and the hysteresis shear damper 86 is interposed between the virtual rigid beam 93 and the upper end of the eccentric brace material 85.

Here, since the RC rigid frame 84 is plasticized at the upper and lower ends of the pillar 82, the pillar 82 has a curvature only at its upper and lower ends, and is linearly inclined in the middle position. Therefore the deformed RC rigid frame 84 forcibly deforms the hysteresis shear damper 86 according to the ratio for the position of the pillar 82 pinned to the eccentric brace material 85, that is, (h'/h) in the above-described example, and as a result, the hysteresis shear damper 86 causes a relative deformation of (h'/h) δ.

Therefore, there is a sufficient engineering appropriateness to replace the pillar 82 and beam 83 with the virtual rigid pillar 92 and virtual rigid beam 93, pin-connect the pillar and beam to each other, and interpose the hysteresis shear damper 86 between the virtual rigid beam 93 and the upper end of the eccentric brace material 85.

After the modeling of the RC analysis model 89 and damper-brace analysis model 90 ends in this manner, a design external force P to be exerted to the elevated bridge infrastructure 81 is distributed to the RC analysis model 89 and damper-brace analysis model 90. Specifically, $P_{db}$ is applied to the damper-brace analysis model 90, $P_{rc}$ ($P_{rc}=P-P_{db}$) is applied to the RC analysis model 89, the elasto-plastic analyses are individually performed, subsequently the section design is performed according to the analysis results, and the entire performance of the elevated bridge infrastructure 81 is evaluated as the overlapped analysis results.

Here, when the load deformation characteristic of the hysteresis shear damper 86 (load curve with respect to the relative displacement amount δ) is defined as $H_b$, the forcible relative deformation (h'/h) δ enters the hysteresis damper 86, and the load $P_{db}$ of the damper-brace analysis model 90 is automatically determined from the forcible deformation, and can be represented as $(h'/h)H_b$.

As seen from this equation, when (h'/h) is determined, the load $P_{db}$ of the damper-brace analysis model 90 is uniquelly determined by the damper load displacement characteristic $H_b$.

Figure 22:
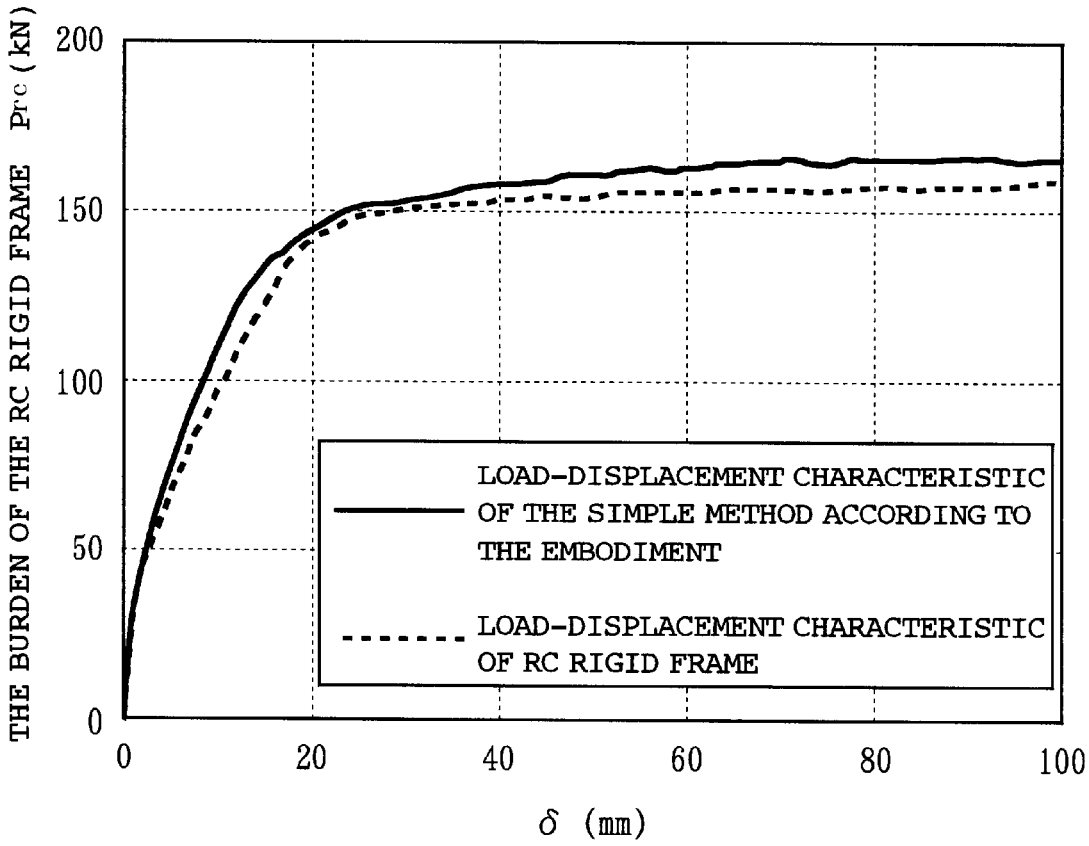
FIG. 22 is a graph showing a result obtained by verifying the appropriateness of the seismic frame structure design method according to the present invention.

FIG. 22 is a graph showing a result obtained by verifying the appropriateness of the designing by a so-called simple method as described above. FIG. 22 shows a load displacement curve in which the ordinate indicates the load acting on the RC rigid frame and the abscissa indicates the generated displacement, a solid line is drawn by setting (h'/h) to about 0.6, setting the load $P_{rc}$ of the RC rigid frame to $(P-0.6H_b)$ and plotting analysis results according to the above-described simple method, and a dotted line is drawn by taking out only the RC rigid frame and plotting the load displacement relation.

As seen from FIG. 22, the true load displacement relation (dotted line) of the RC rigid frame considerably satisfactorily agrees with the load displacement relation obtained by the above-described simple method, and it can be said that the appropriateness of the simple method is sufficiently verified.

As described above, according to the seismic frame structure of the present embodiment, since both ends of the eccentric brace material 85 are connected in the vicinities of the middle positions of the pillars 82, the relative horizontal deformation amount generated in the hysteresis shear damper 86 is reduced to be smaller than the horizontal deformation amount generated in the RC rigid frame 84 in accordance with the ratio (h'/h) of the attachment heights of the ends of the eccentric brace material 85. For example, when the end is connected right to the bisector point of the pillar, the amount is reduced to provide substantially half of the horizontal deformation amount generated in the RC rigid frame 84.

Therefore, it is possible to deform the RC rigid frame 84 by the deformation amount twice as large as the conventional amount and sufficiently utilize the ductility, and in cooperation with the vibration energy absorption action by the hysteresis damping of the hysteresis shear damper 86, it is possible to secure a sufficient resistance against a big earthquake by a more reasonable section design without requiring a large section design.

Moreover, according to the seismic frame structure of the present embodiment, since the eccentric brace material 85 is pinned to the pillars 82, there is no possibility that the bending moment is generated in the ends of the eccentric brace material 85, so that the bending failure of the ends of the eccentric brace material in the pin connection places can be prevented beforehand.

Furthermore, according to the seismic frame structure of the present embodiment, since both ends of the inverse V-shaped eccentric brace material 85 are attached in the vicinities of the middle height positions of a pair of pillars 82, 82, a large space can be secured under the eccentric brace material 85.

Therefore, the space under the eccentric brace material 85 can be used as a space for laying a business route railroad, and effective utilization is possible in other various manners.

Additionally, according to the seismic frame structure of the present embodiment, since the inverse V-shaped eccentric brace material 85 is disposed in the structural plane of the RC rigid frame 84, the rigidity can sufficiently be secured by the eccentric brace material 85 in the horizontal direction crossing at right angles to the bridge axis without installing any foundation beam.

Moreover, according to the design method of the seismic frame structure of the present embodiment, although the complicated structure model with the RC rigid frame 84 and damper-brace (eccentric brace material 85 and hysteresis shear damper 86) mixed therein is in the prior art, the RC rigid frame 84 and the damper-brace can independently and individually be analyzed in a similar manner, and a remarkably effective simple design method can be realized in design business.

Figure 23:
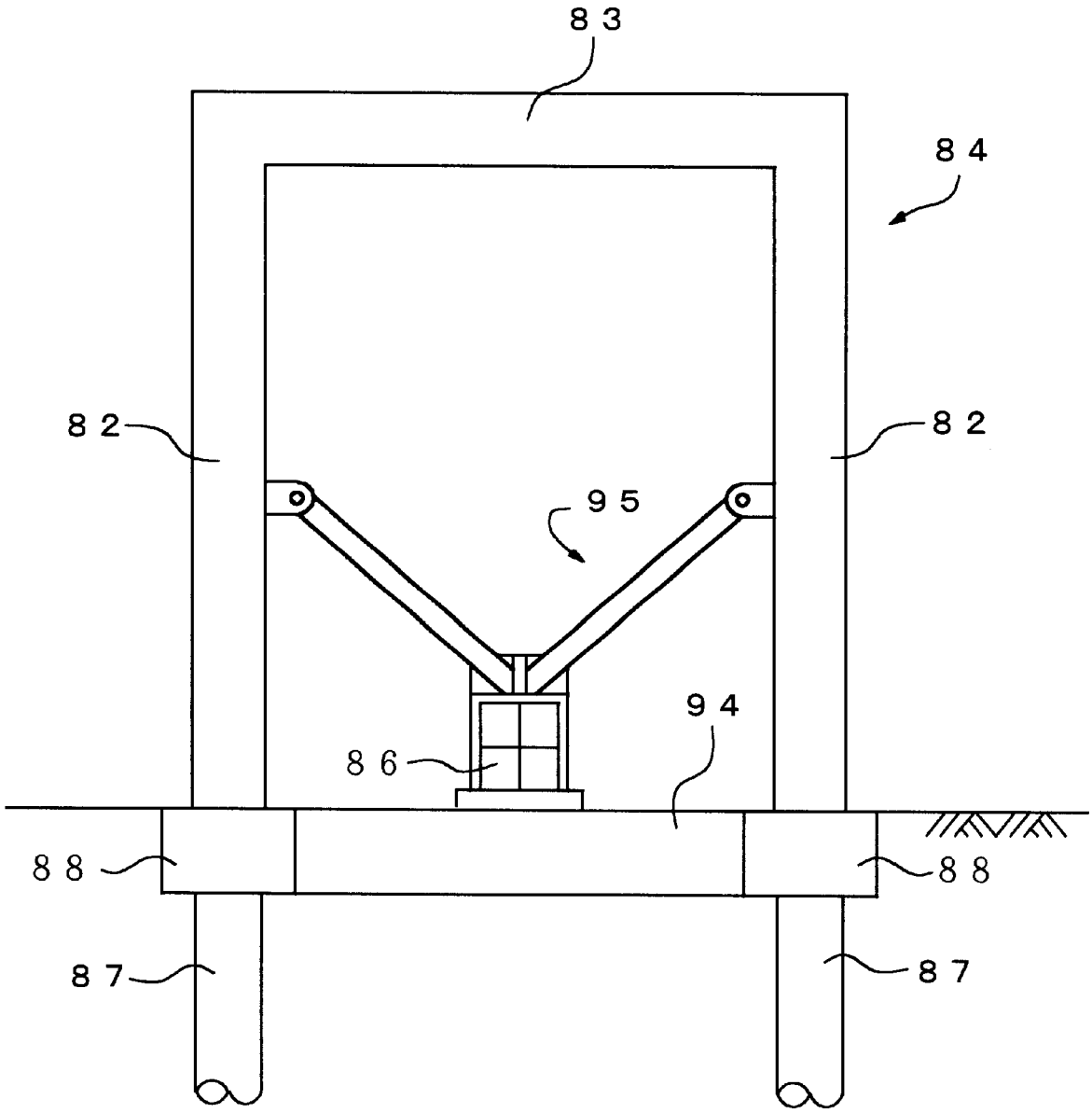
FIG. 23 is a front view of a modified elevated bridge infrastructure as the seismic frame structure as seen from the bridge axial direction.

In the present embodiment, the eccentric brace material 85 has an inverse V-shape, but instead of this, as shown in FIG. 23, a V-shaped eccentric brace material 95 may be employed, and the lower end may be connected via the hysteresis shear damper 86 to a foundation beam 94 for connecting footings 88, 88 on which the pillars 82, 82 are vertically disposed.

Even in this constitution, the effect of the seismic frame structure is similar to the effect of the above-described embodiments.

Moreover, for the design method, the design can be performed using the procedure similar to the above-described procedure. Specifically, first, the elevated bridge infrastructure 81 as the seismic frame structure is disassembled into two and modeled similarly to the RC analysis model 89 and damper-brace analysis model 90 shown in FIG. 21.

Here, the RC analysis model may be similar to the RC analysis model 89 obtained by assuming that the RC rigid frame 84 is plasticized at the upper and lower ends of the pillar 82, and replacing the rigid joint (pillar head and pillar leg) of the RC rigid frame with the rotational spring 91.

Figure 24:
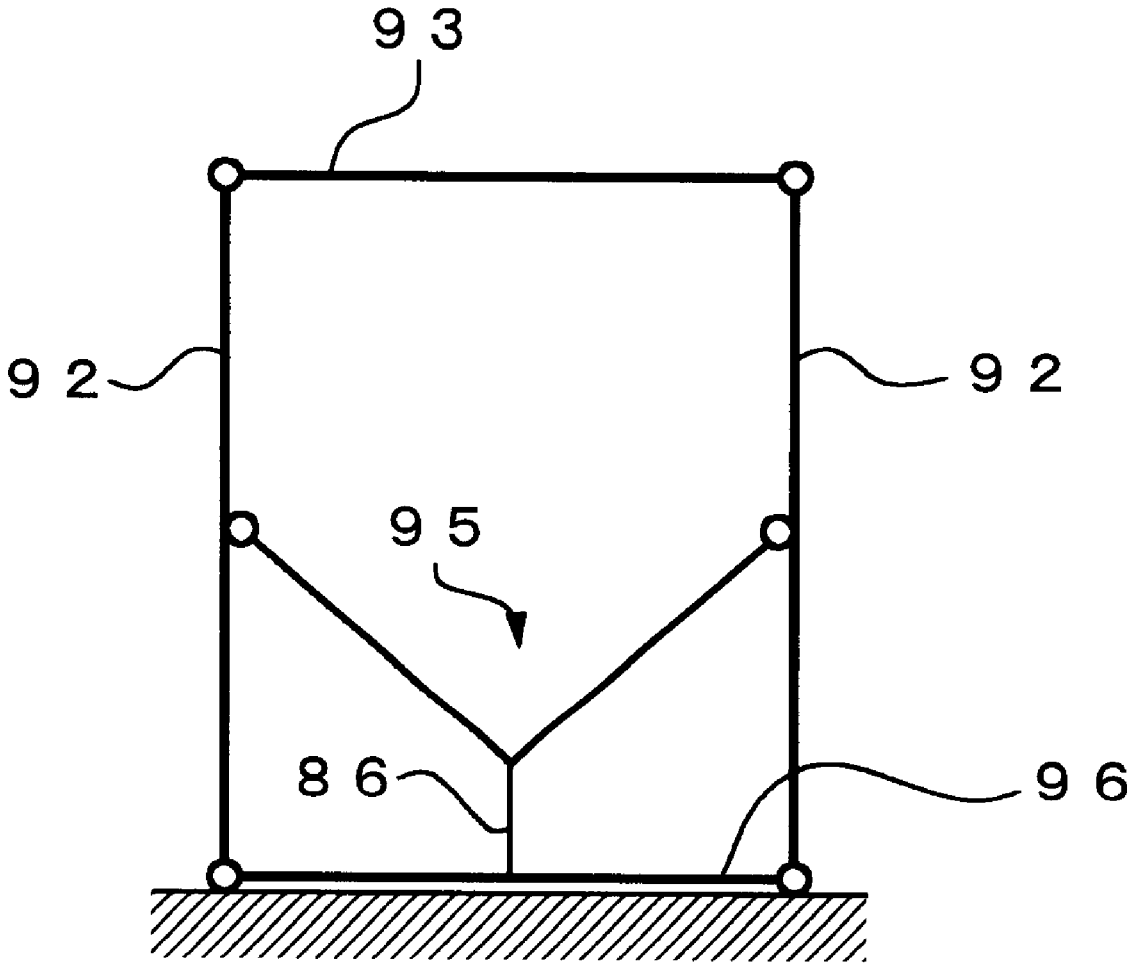
FIG. 24 is a schematic diagram showing a modified seismic frame structure design method.

On the other hand, the damper-brace analysis model may be considered and obtained by replacing the pillar 82 and beam 83 with the virtual rigid pillar 92 and virtual rigid beam 93, pinning the pillar and beam to each other, also replacing the foundation beam 94 with a virtual rigid foundation beam 96 as shown in FIG. 24, pinning the beam to the leg part of the virtual rigid pillar 92, and interposing the hysteresis shear damper 86 between the virtual rigid foundation beam 96 and the upper end of the eccentric brace material 95.

We claim:

1. A method of designing an elevated bridge infrastructure including a reinforced concrete rigid frame and a damper-brace disposed in a structural plane, said method comprising:

setting a target ductility factor $\mu_d$ and a target natural period $T_d$ for the infrastructure in an assumed earthquake motion;

obtaining a yield seismic coefficient corresponding to the target ductility factor $\mu_d$ and the target natural period $T_d$ from a yield seismic coefficient spectrum corresponding to the assumed earthquake motion to provide a design seismic coefficient $K_h$, and obtaining a target yield rigidity $K_d$ corresponding to the target natural period $T_d$;

using the design seismic coefficient $K_h$ to obtain a design horizontal load bearing capacity $H_d$, and obtaining a displacement corresponding to the design horizontal load bearing capacity $H_d$ as a design yield displacement $\delta_d$ from the target yield rigidity $K_d$, distributing the design horizontal load bearing capacity $H_d$ to a horizontal force $H_f$ to be borne by the reinforced concrete rigid frame and a horizontal force $H_b$ to be borne by the damper-brace; and setting member sections of the reinforced concrete rigid frame and the damper-brace so that the reinforced concrete rigid frame and the damper-brace are to resist the horizontal forces $H_f$, $H_b$ with an ultimate load bearing capacity, and displacements corresponding to the horizontal forces $H_f$, $H_b$ equal a product of the design yield displacement $\delta_d$ and the target ductility factor $\mu_d$.

2. The method according to claim 1, further comprising:

using the set member sections of the reinforced concrete rigid frame and the damper-brace to generate a structure analysis model of the infrastructure;

performing static nonlinear analysis on the structure analysis model;

performing static nonlinear analysis on the structure analysis model;

evaluating a retaining yield rigidity $K_y$, a retaining yield displacement $\delta_y$, a retaining yield load bearing capacity $H_y$ and a retaining maximum displacement $\delta_u$ from a load-displacement relationship obtained by the static nonlinear analysis;

using a retaining natural period T obtained from the retaining yield rigidity $K_y$ to obtain a necessary ductility factor $\mu$ corresponding to the retaining yield load bearing capacity $H_y$ from the yield seismic coefficient spectrum;

multiplying the necessary ductility factor $\mu$ by the retaining yield displacement $\delta_y$ to obtain a response maximum displacement $\delta_{max}$;

comparing the response maximum displacement $\delta_{max}$ with the retaining maximum displacement $\delta_u$, calculating member response maximum displacements $\delta'_{max}$ corresponding to the response maximum displacement $\delta_{max}$ for each of the reinforced concrete rigid frame and the damper-brace, and comparing the member response maximum displacements $\delta'_{max}$ with member retaining maximum displacements $\delta'_u$, respectively, to check the set member sections of the reinforced concrete rigid frame and the damper-brace.

3. A method of designing an elevated bridge infrastructure including a reinforced concrete rigid frame and a damper-brace disposed in a structural plane, said method comprising:

setting a target ductility factor $\mu_d$ and a target natural period $T_d$ for the infrastructure in an assumed earthquake motion;

obtaining an elastic response spectrum seismic coefficient corresponding to the target natural period $T_d$ from an elastic response spectrum corresponding to the assumed earthquake motion;

applying the elastic response spectrum seismic coefficient and the target ductility factor $\mu_d$ to Newmark's rule of constant potential energy to calculate a design seismic coefficient $K_h$, and obtaining a target yield rigidity $K_d$ corresponding to the target natural period $T_d$;

distributing the design horizontal load bearing capacity $H_d$ to a horizontal force $H_f$ to be borne by the reinforced concrete rigid frame and a horizontal force $H_b$ to be borne by the damper-brace; and setting member sections of the reinforced concrete rigid frame and the damper-brace so that the reinforced concrete rigid frame and the damper-brace are to resist the horizontal forces $H_f$, $H_b$ with an ultimate load bearing capacity, and displacements corresponding to the horizontal forces $H_f$, $H_b$ equal a product of the design yield displacement $\delta_d$ and the target ductility factor $\mu_d$.

4. The method according to claim 3, further comprising:

using the set member sections of the reinforced concrete rigid frame and damper-brace to generate a structure analysis model of the infrastructure;

performing static nonlinear analysis on the structure analysis model;

evaluating a retaining yield rigidity $K_y$, a retaining yield displacement $\delta_y$, a retaining yield load bearing capacity $H_y$ and a retaining maximum displacement $\delta_u$ from a load-displacement relationship obtained by the static nonlinear analysis;

using a retaining natural period T obtained from the retaining yield rigidity $K_y$ to obtain an elastic response spectrum seismic coefficient from an elastic response spectrum;

applying the elastic response spectrum seismic coefficient together with the retaining yield load bearing capacity $H_y$ to Newmark's rule of constant potential energy to obtain a necessary ductility factor $\mu$;

multiplying the necessary ductility factor $\mu$ by the retaining yield displacement $\delta_y$ to obtain a response maximum displacement $\delta_{max}$; and comparing the response maximum displacement $\delta_{max}$ with the retaining maximum displacement $\delta_u$, calculating member response maximum displacements $\delta'_{max}$ corresponding to the response maximum displacement $\delta_{max}$ for each of the reinforced concrete rigid frame and the damper-brace, and comparing the member response maximum displacements $\delta'_{max}$ with member retaining maximum displacements $\delta'_u$, respectively, to check the set member sections of the reinforced concrete rigid frame and the damper-brace.

5. A method of designing an elevated bridge infrastructure including a reinforced concrete rigid frame and a damper-brace disposed in a structural plane, said method comprising:

setting a target ductility factor $\mu_d$ and a target natural period $T_d$ for the infrastructure in an assumed earthquake motion;

obtaining an elastic response spectrum seismic coefficient corresponding to the target natural period $T_d$ from an elastic response spectrum corresponding to the assumed earthquake motion;

dividing the elastic response spectrum seismic coefficient by a response modification factor determined by a structure type to calculate a design seismic coefficient $K_h$, and obtaining a target yield rigidity $K_d$ corresponding to the target natural period $T_d$;

using the design seismic coefficient $K_h$ to obtain a design horizontal load bearing capacity $H_d$, and obtaining a displacement corresponding to the design horizontal load bearing capacity $H_d$ as a design yield displacement $\delta_d$ from the target yield rigidity $K_d$;

distributing the design horizontal load bearing capacity $H_d$ to a horizontal force $H_f$ to be borne by the reinforced concrete rigid frame and a horizontal force $H_b$ to be borne by the damper-brace; and setting member sections of the reinforced concrete rigid frame and the damper-brace so that the reinforced concrete rigid frame and the damper-brace are to resist the horizontal forces $H_f$, $H_b$ with an ultimate load bearing capacity, and displacements corresponding to the horizontal forces $H_f$, $H_b$ equal a product of the design yield displacement $\delta_d$ and the target ductility factor $\mu_d$.

6. The method according to claim 5, further comprising:

using the set member sections of the reinforced concrete rigid frame and the damper-brace to generate a structure analysis model of the infrastructure;

performing static nonlinear analysis on the structure analysis model;

evaluating a retaining maximum displacement $\delta_u$ from a load-displacement relationship obtained by the static nonlinear analysis;

performing dynamic nonlinear analysis on the assumed earthquake motion to obtain a response maximum displacement $\delta_{max}$ of the infrastructure; and comparing the response maximum displacement $\delta_{max}$ with the retaining maximum displacement $\delta_u$, calculating member response maximum displacements $\delta'_{max}$ corresponding to the response maximum displacement $\delta_{max}$ for each of the reinforced concrete rigid frame and the damper-brace, and comparing the member response maximum displacements $\delta'_{max}$ with member retaining maximum displacements $\delta'_u$, respectively, to check the set member sections of the reinforced concrete rigid frame and the damper-brace.

* * * * *